US012066245B2

(12) United States Patent
Jacob

(10) Patent No.: US 12,066,245 B2
(45) Date of Patent: Aug. 20, 2024

(54) PORTABLE BEVERAGE COOLERS AND METHODS OF USING THE SAME

(71) Applicant: BruMate, INC., Denver, CO (US)

(72) Inventor: Dylan M. Jacob, Denver, CO (US)

(73) Assignee: BruMate, INC., Denver, CO (US)

( * ) Notice: Subject to any disclaimer, the term of this patent is extended or adjusted under 35 U.S.C. 154(b) by 288 days.

(21) Appl. No.: 17/541,224

(22) Filed: Dec. 2, 2021

(65) Prior Publication Data

US 2022/0170683 A1 Jun. 2, 2022

Related U.S. Application Data

(60) Provisional application No. 63/120,695, filed on Dec. 2, 2020.

(51) Int. Cl.

| | |
|---|---|
| ***F25D 3/08*** | (2006.01) |
| ***B65D 25/28*** | (2006.01) |
| ***B65D 25/42*** | (2006.01) |
| ***B65D 43/16*** | (2006.01) |
| ***B65D 85/72*** | (2006.01) |

(52) U.S. Cl.

CPC ..... *F25D 3/08* (2013.01); *B65D 25/2841* (2013.01); *B65D 25/42* (2013.01); *B65D 43/163* (2013.01); *B65D 85/72* (2013.01); *B65D 2543/00231* (2013.01)

(58) Field of Classification Search

CPC ..... F25D 3/08; B65D 25/2841; B65D 25/42; B65D 43/163; B65D 85/72; B65D 2543/00231; B65D 81/3802; A45F 2003/166; A45F 3/02; A45F 3/04; A45C 2013/026; A45C 2200/20; A45C 11/20; A45C 13/02

See application file for complete search history.

(56) References Cited

U.S. PATENT DOCUMENTS

| | | | | |
|---|---|---|---|---|
| 5,329,787 | A * | 7/1994 | Friday | F25D 3/08 62/530 |
| 5,403,095 | A * | 4/1995 | Melk | A45C 11/20 383/110 |
| 6,993,931 | B1 * | 2/2006 | Hamilton | A45B 23/00 62/457.7 |
| 2007/0028642 | A1 * | 2/2007 | Glade | A61B 90/98 62/457.2 |
| 2009/0078709 | A1 * | 3/2009 | Murrer, III | G21F 9/36 220/592.2 |
| 2018/0162626 | A1 * | 6/2018 | Munie | A45C 13/26 |
| 2019/0092530 | A1 * | 3/2019 | Seiders | B65D 43/164 |
| 2020/0170390 | A1 * | 6/2020 | Nicks, III | A47C 13/00 |
| 2020/0189807 | A1 * | 6/2020 | Bullock | B65D 81/3823 |
| 2021/0024276 | A1 * | 1/2021 | Bradley | A45C 13/36 |

* cited by examiner

*Primary Examiner* — Emmanuel E Duke

(74) *Attorney, Agent, or Firm* — Shook, Hardy & Bacon L.L.P.

(57) ABSTRACT

Portable beverage coolers and methods of using the same. An exemplary cooler described herein comprises an outer shell having a general shape as a container, suitable to receive contents therein, a handle pivotally coupled to the outer shell a removable insert configured to fit within the outer shell, said insert configured to receive a liquid or other items therein, and a hinged lid coupled to the outer shell. Said coolers are configured to retain a beverage therein, maintaining a desired cold temperature, and to dispense beverage directly therefrom via a tap.

20 Claims, 43 Drawing Sheets

PORTABLE BEVERAGE COOLERS AND METHODS OF USING THE SAME

PRIORITY

The present application is related to, and claims the priority benefit of, U.S. Provisional Patent Application Ser. No. 63/120,695, filed Dec. 2, 2020, the contents of which are incorporated herein directly and by reference in their entirety.

BACKGROUND

Beverage coolers have been used for decades to keep beverages, such as cans of beer or soda on ice, cold for an extended period of time. Typical coolers can be carried using a handle or rolled along the ground or floor by way of two wheels when a user is pulling the cooler at an angle. These types of coolers can be heavy, unwieldy, and are frequently too large to bring to a sporting event, camping, hiking, and the like. Those beverage coolers, when there is a liquid present inside (such as water from melted ice), would leak when tipped or otherwise inverted from an upright position.

Soft beverage coolers, such as soft lunch bags but larger, are also on the market. Those coolers can be relatively small, but can also be of any number of suitable sizes. The downside of those coolers is that the material is thin and does not insulate the contents well, such as cans of beer and ice packs. If ice were used inside, the cooler would leak from the zipper or other closure mechanism when tipped or otherwise inverted.

As such, a beverage cooler, made of a durable and lightweight material, capable of easy and effective cleaning, easy to carry and with various carrying options, being leak proof, and having any number of other features, would be well received in the marketplace.

BRIEF SUMMARY

The present disclosure includes disclosure of a cooler, comprising an outer shell having a general shape as a container, suitable to receive contents therein; a handle pivotally coupled to the outer shell a removable insert configured to fit within the outer shell, said insert configured to receive a liquid or other items therein; and a hinged lid coupled to the outer shell.

The present disclosure includes disclosure of a cooler, further comprising a gasket, said gasket coupled to the hinged lid or to an upper portion of the outer shell configured to contact the hinged lid.

The present disclosure includes disclosure of a cooler, further comprising a tap in fluid communication with the inside of the insert, such that said tap is positioned through apertures defined within the outer shell and the insert.

The present disclosure includes disclosure of a cooler, further comprising a comfort grip on the handle.

The present disclosure includes disclosure of a cooler, wherein the hinged lid has a vent mechanism present therein, the vent mechanism configured to allow gaseous movement in and out of the cooler.

The present disclosure includes disclosure of a cooler, wherein the hinged lid has a latch coupled thereto, said latch configured to engage an engagement feature defined within or protruding from the outer shell.

The present disclosure includes disclosure of a cooler, further comprising pliable feet positioned on a relative bottom of the outer shell.

The present disclosure includes disclosure of a cooler, further comprising at least two strap receivers defined within or present upon a relative back of the outer shell, the at least two strap receivers configured to engage connection portions of a backpack strap or a shoulder strap.

The present disclosure includes disclosure of a cooler, further comprising at least four strap receivers defined within or present upon a relative back of the outer shell, the at least four strap receivers configured to engage connection portions of one or more backpack straps.

The present disclosure includes disclosure of a cooler, further comprising a seat feature positioned upon the lid, the seat feature configured to provide comfort to a user seated upon said seat feature.

The present disclosure includes disclosure of a cooler, further comprising a gasket, said gasket coupled to the hinged lid or to an upper portion of the outer shell configured to contact the hinged lid; and a tap in fluid communication with the inside of the insert, such that said tap is positioned through apertures defined within the outer shell and the insert.

The present disclosure includes disclosure of a cooler, further comprising a comfort grip on the handle.

The present disclosure includes disclosure of a cooler, wherein the hinged lid has a vent mechanism present therein, the vent mechanism configured to allow gaseous movement in and out of the cooler.

The present disclosure includes disclosure of a cooler, wherein the hinged lid has a latch coupled thereto, said latch configured to engage an engagement feature defined within or protruding from the outer shell.

The present disclosure includes disclosure of a cooler, further comprising pliable feet positioned on a relative bottom of the outer shell.

The present disclosure includes disclosure of a cooler, further comprising at least two strap receivers defined within or present upon a relative back of the outer shell, the at least two strap receivers configured to engage connection portions of a backpack strap or a shoulder strap.

The present disclosure includes disclosure of a cooler, further comprising at least four strap receivers defined within or present upon a relative back of the outer shell, the at least four strap receivers configured to engage connection portions of one or more backpack straps.

The present disclosure includes disclosure of a cooler, further comprising a seat feature positioned upon the lid, the seat feature configured to provide comfort to a user seated upon said seat feature.

The present disclosure includes disclosure of a cooler, comprising an outer shell having a general shape as a container, suitable to receive contents therein; a handle pivotally coupled to the outer shell; a removable insert configured to fit within the outer shell, said insert configured to receive a liquid or other items therein; a hinged lid coupled to the outer shell, wherein the hinged lid has a vent mechanism present therein, the vent mechanism configured to allow gaseous movement in and out of the cooler; a gasket, said gasket coupled to the hinged lid or to an upper portion of the outer shell configured to contact the hinged lid; a tap in fluid communication with the inside of the insert, such that said tap is positioned through apertures defined within the outer shell and the insert; and at least two strap receivers defined within or present upon a relative back of the outer shell, the at least two strap receivers configured to engage connection portions of a backpack strap or a shoulder strap; wherein the hinged lid has a latch coupled thereto, said latch configured to engage an engagement feature defined within or protruding from the outer shell.

The present disclosure includes disclosure of a cooler, further comprising pliable feet positioned on a relative bottom of the outer shell; and a seat feature positioned upon the lid, the seat feature configured to provide comfort to a user seated upon said seat feature.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1:
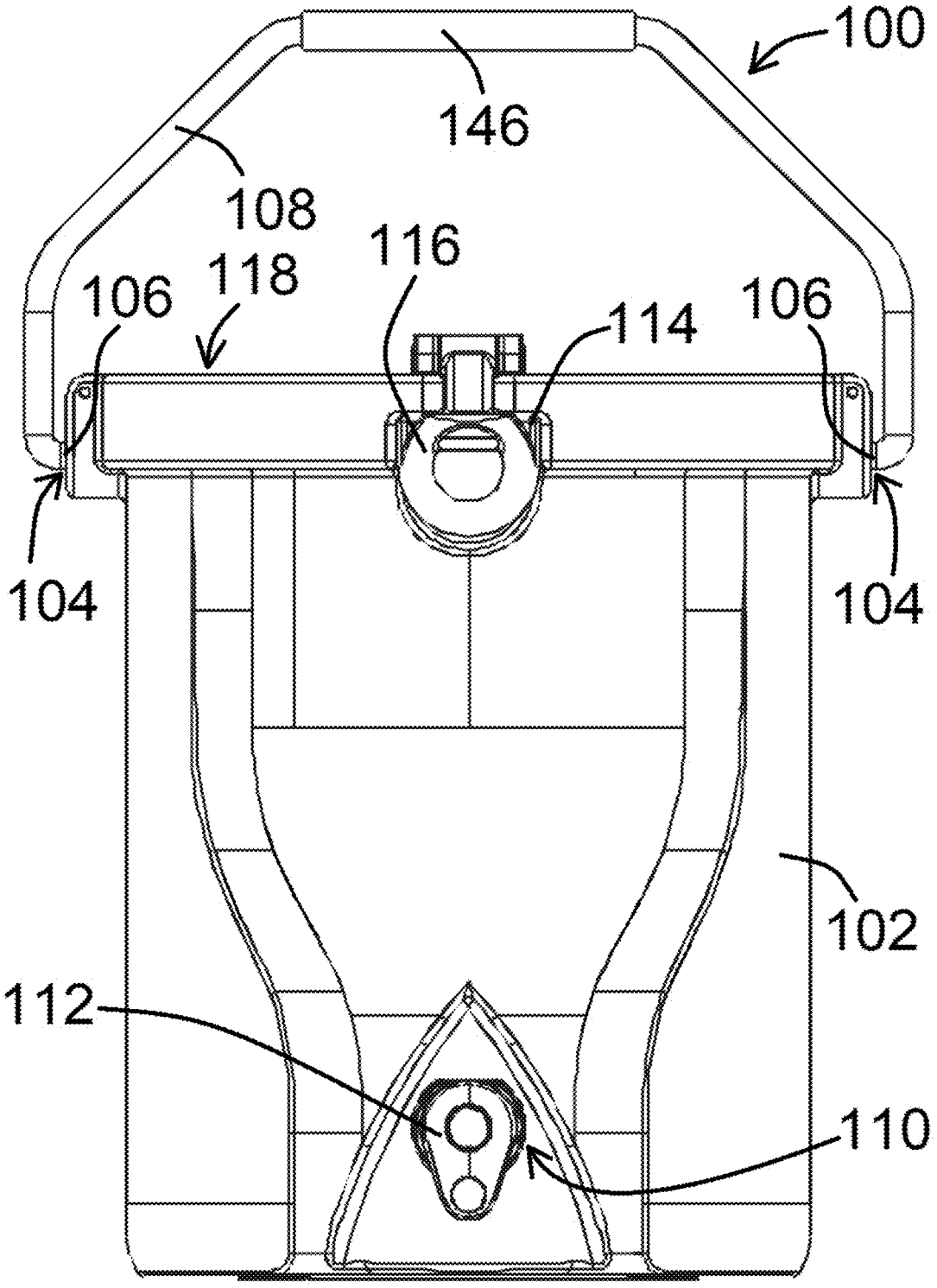
FIG. 1 shows a front view of a cooler having a closed lid, according to an exemplary embodiment of the present disclosure.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Several exemplary cooler embodiments of the present disclosure are shown in the accompanying figures.

FIGS. 1-4 show various views of an exemplary cooler 100 of the present disclosure. As shown therein, an exemplary cooler 100 of the present disclosure comprises an outer shell 102 (a durable external shell), which can be made of plastic, metal, or any number of other materials, preferably a lightweight material. Outer shell 102, as shown in the various figures, has a general cylindrical or substantially cylindrical shape as a container, such as a glass, cup, mug, bowl, etc, suitable to receive a liquid or other contents therein (or within an insert 140, as described in further detail herein). Outer shell 102 can have notches 104 formed or defined therein to receive relative ends 106 of a handle 108, so that cooler 100 itself can be picked up and carried using handle 108. Outer shell 102, in various embodiments, can also have a tap aperture 110 formed or defined therethrough configured to receive at least part of a tap 112 therethrough, such as shown in FIGS. 1-7. Outer shell 102, in connection with other portions of cooler 100, provides adequate insulation so to keep beverages therein cool, as referenced in further detail herein.

In various cooler 100 embodiments, outer shell 102 can also have an engagement feature 114 defined therein, configured to receive at least part of a latch 116, wherein when latch 116 is connected to a lid 118 pivotally coupled to outer shell 102, and when the lid 118 can pivot about the outer shell 102 using a hinge 122, part of the latch 116 can be received by the engagement feature 114 to secure the lid 118 in a closed position. Engagement feature 114, in various embodiments, can be an indention defined within outer shell 102 or a protrusion extending from outer shell 102, as may be desired.

Figure 27:
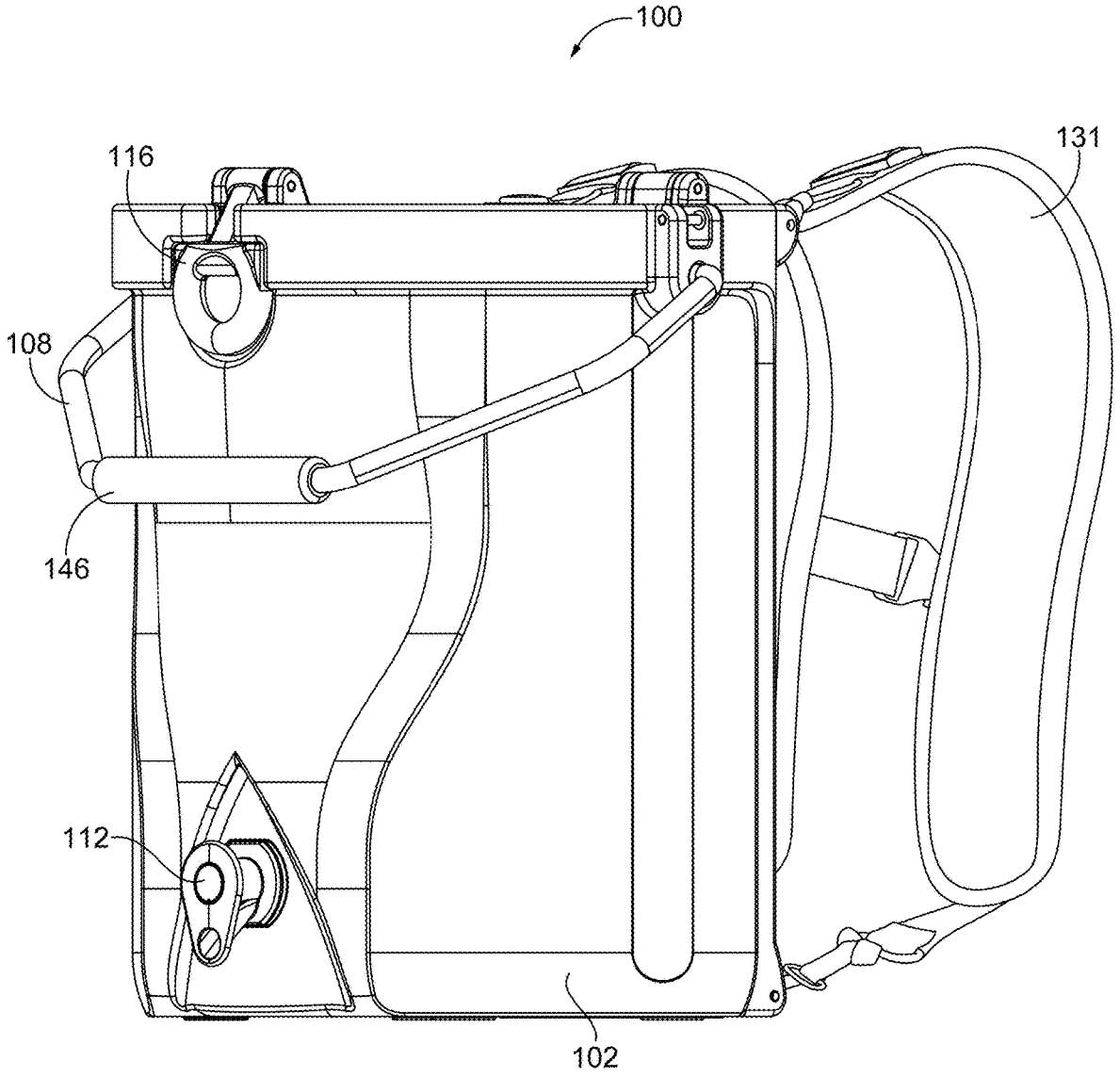
FIG. 27 is a photograph of a cooler in perspective view, with the lid secured closed, and with backpack straps connected thereto, according to an exemplary embodiment of the present disclosure.
Figure 37:
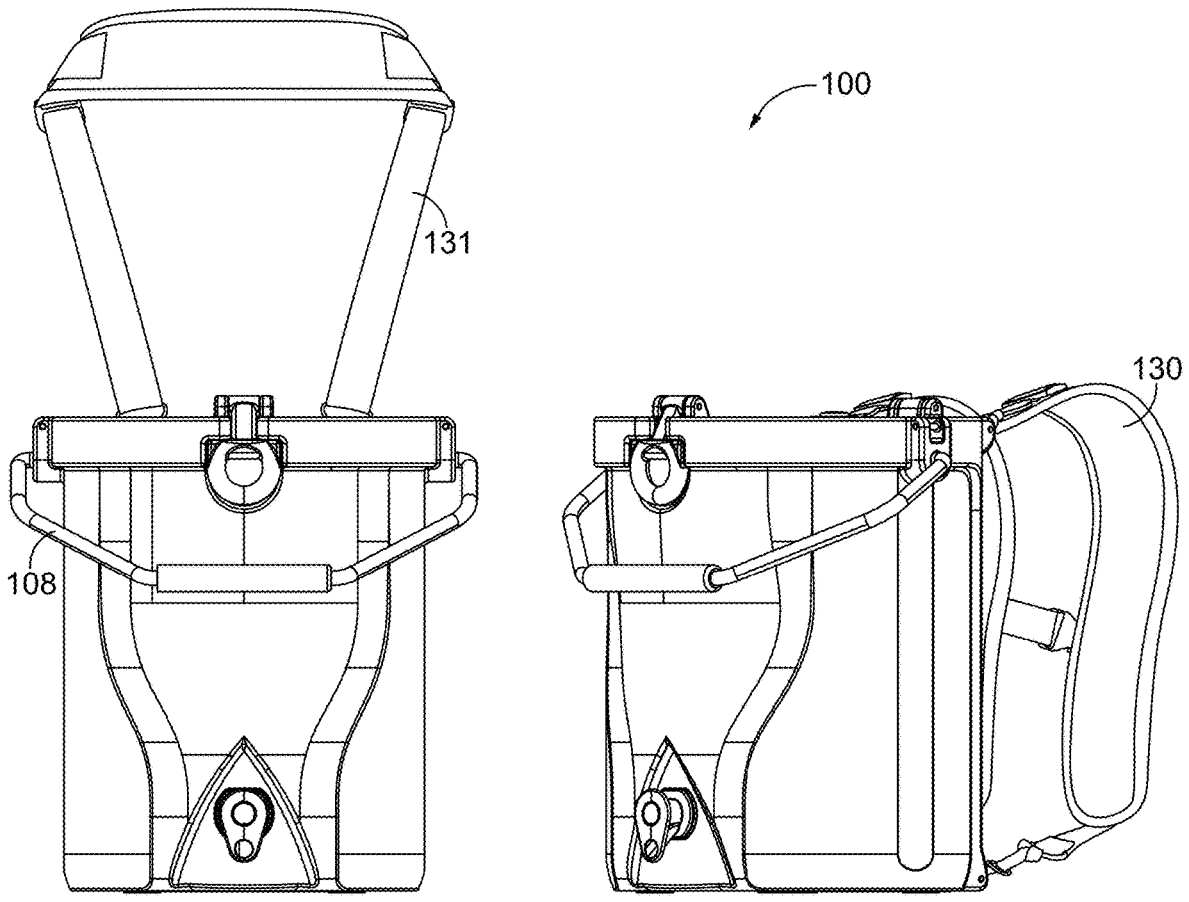
FIG. 37 is two photographs of coolers, one front view and one perspective view, with the front view having a shoulder strap connected to the cooler and with the perspective view having backpack straps connected to the cooler, and describing three ways of carrying the cooler, according to an exemplary embodiment of the present disclosure.
Figure 38:
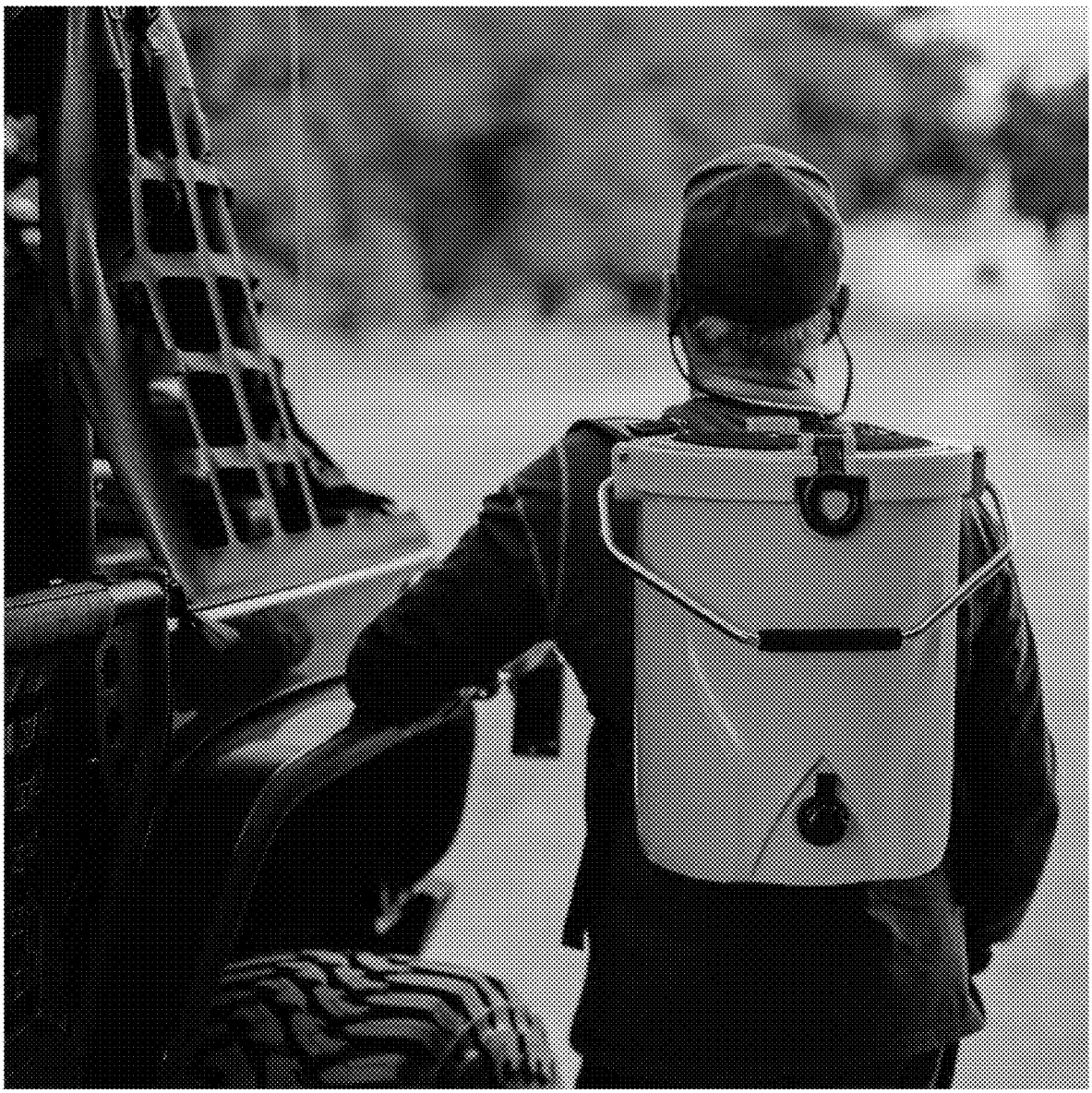
Figure 39:
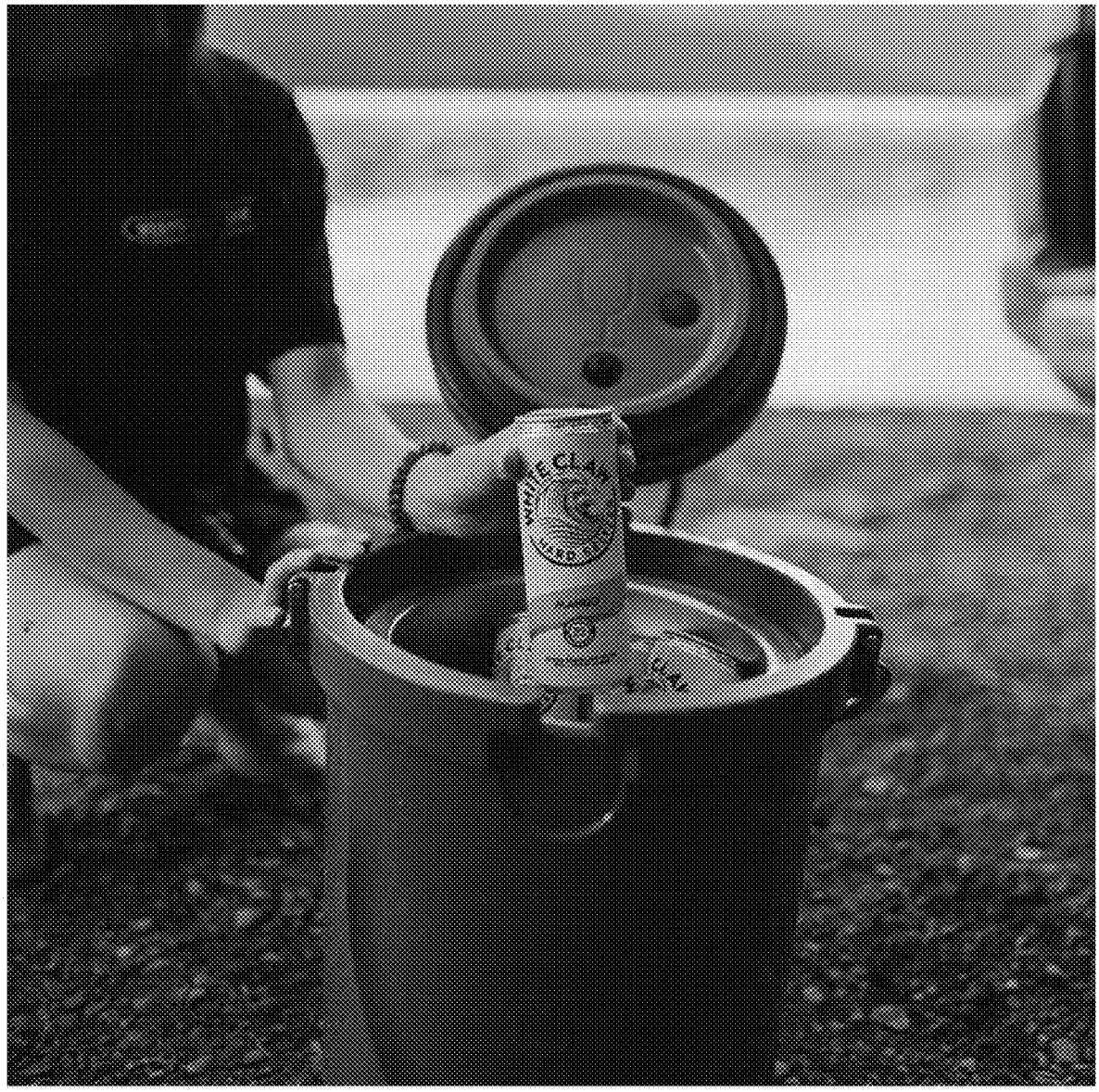
Figure 40:
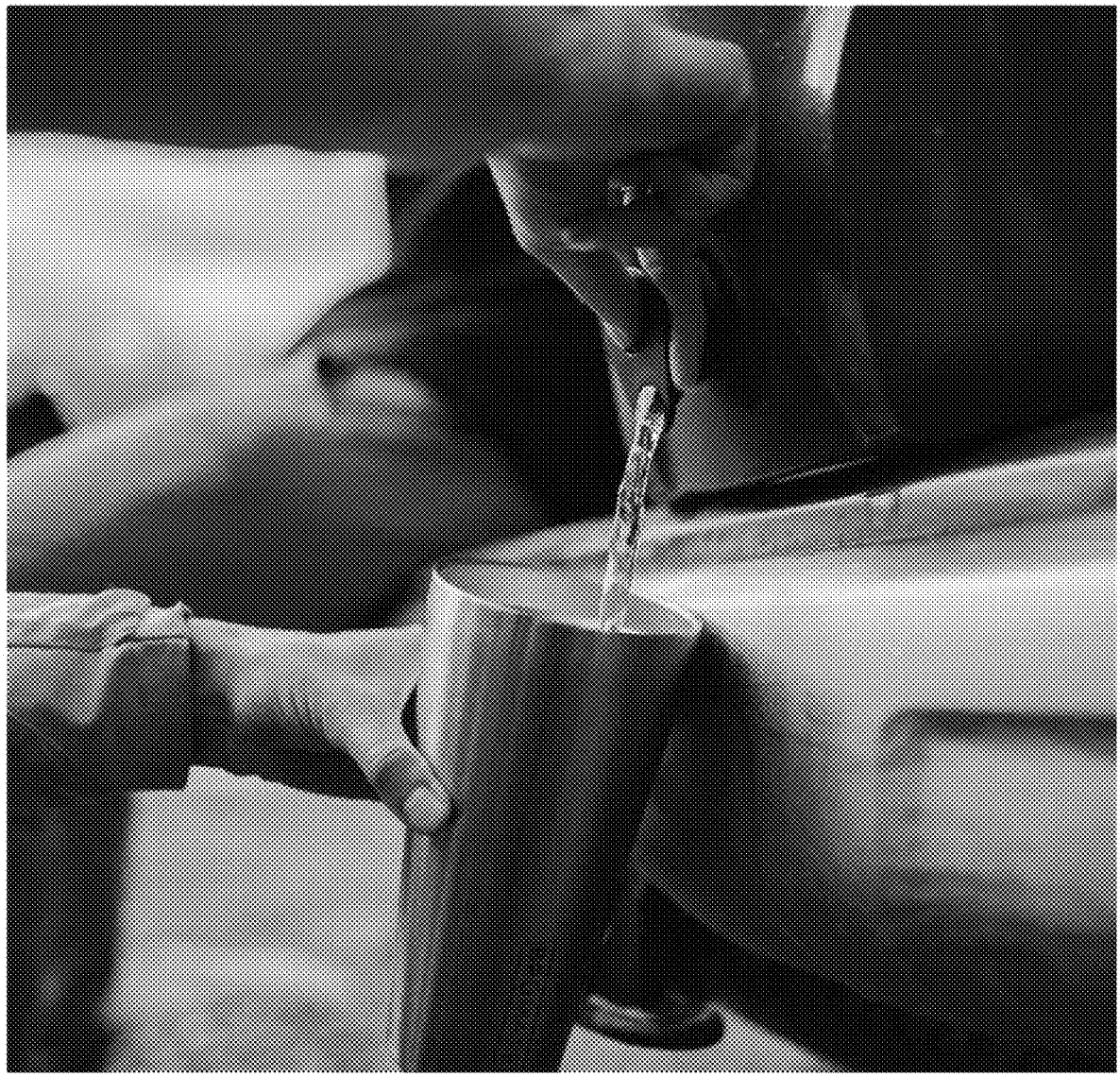
Figure 41:
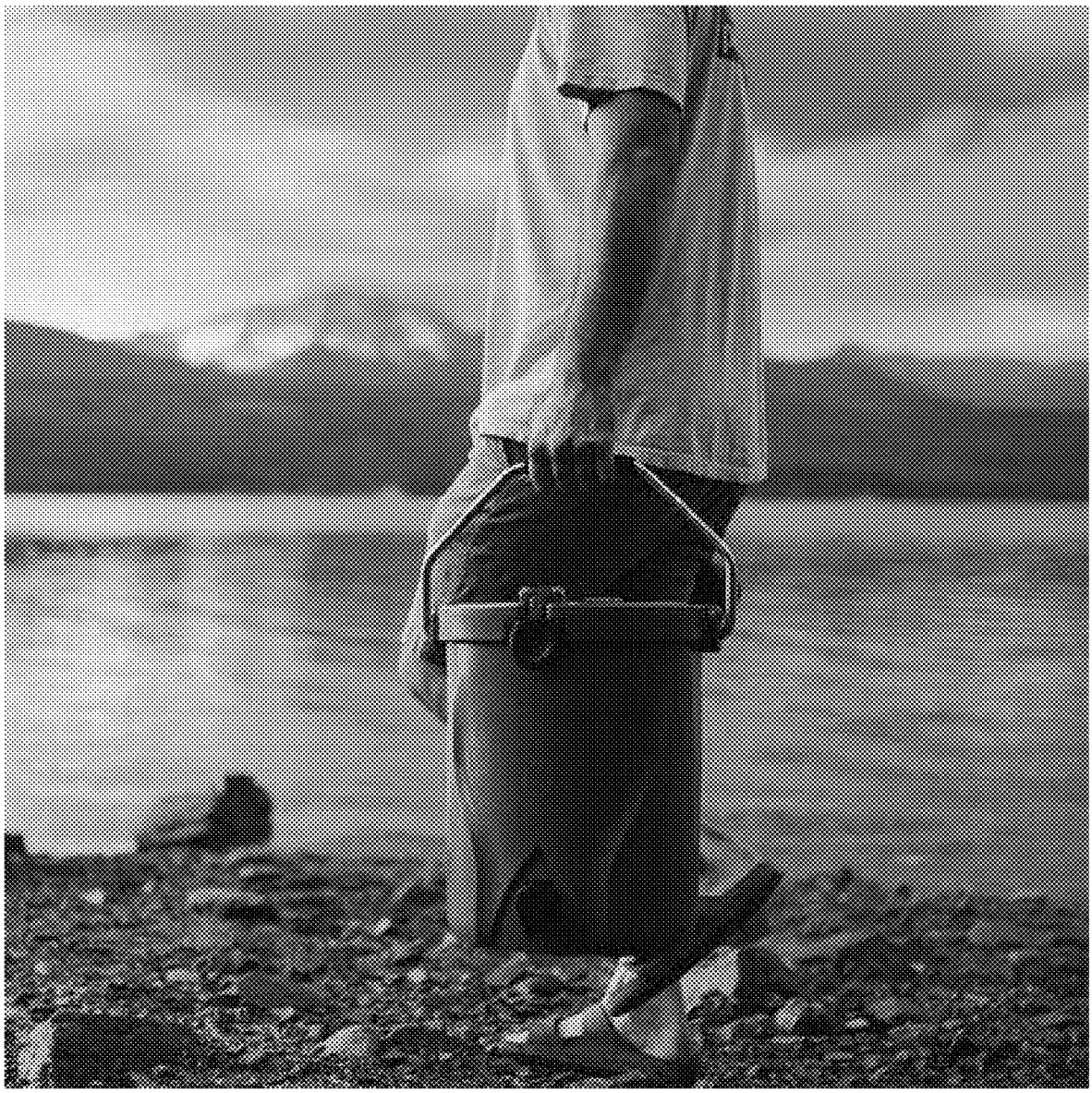
Figure 42:
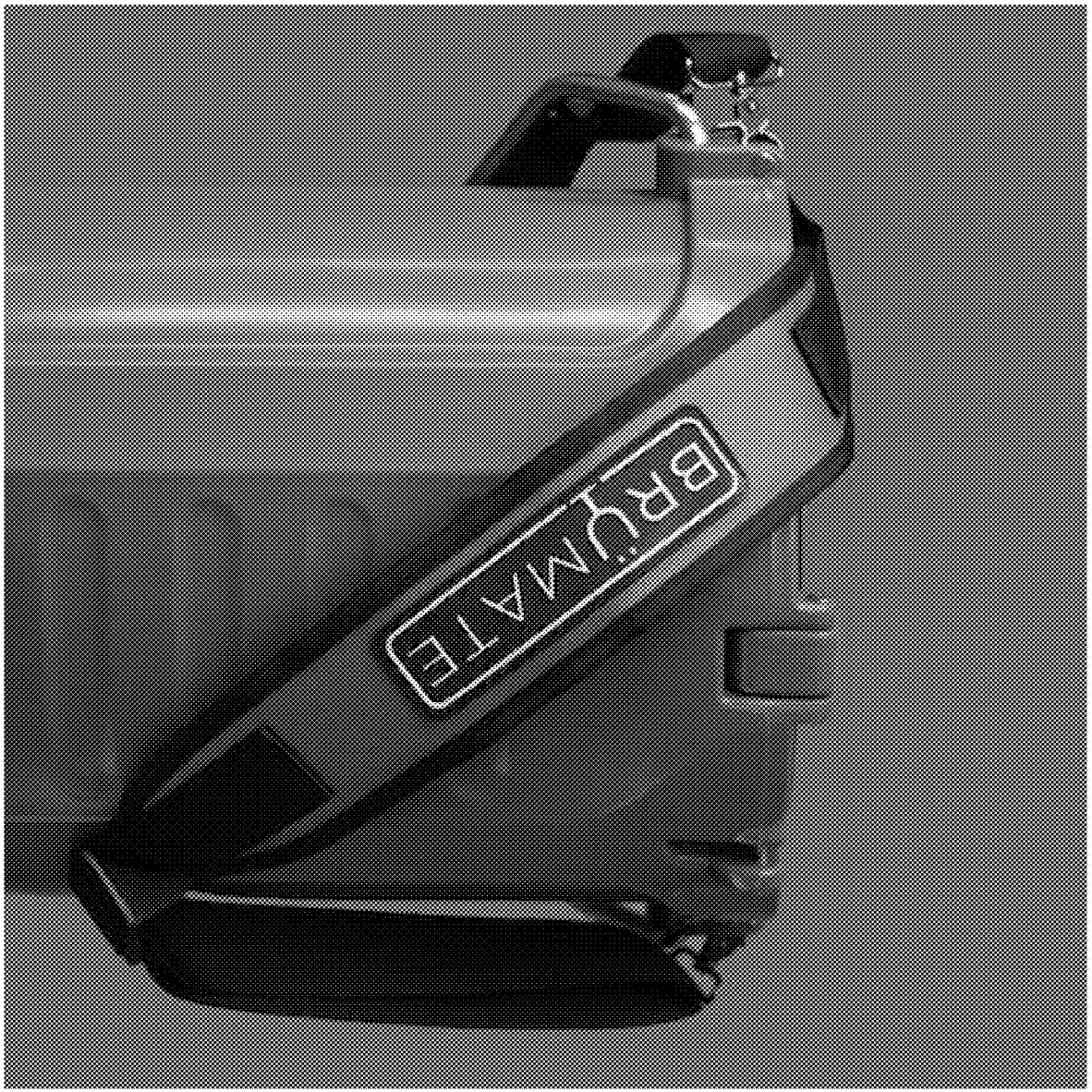
Figure 43:
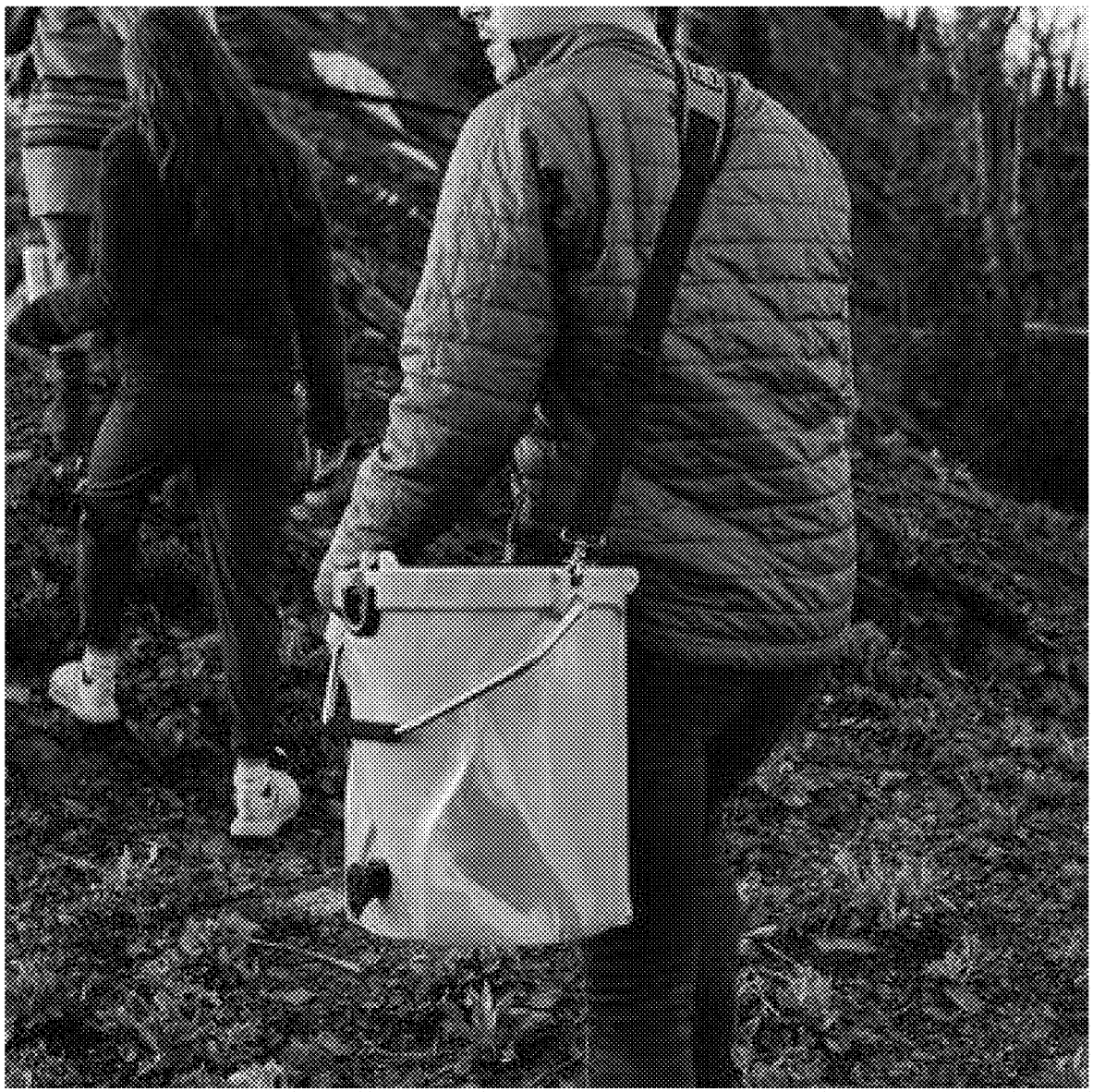

Outer shell 102, in various embodiments, can have several strap receivers 120, such as two strap receivers 120 at a relative top 124 of outer shell 102 and two strap receivers 120 at a relative bottom 126, of the back 128 of the outer shell 102 of the cooler 100. Strap receivers 120 therefore can allow backpack straps 130 to be connected thereto (such as connected to all four strap receivers 120 shown in FIGS. 27 and 37), or just one backpack strap 130 or a shoulder strap 131 (as shown in FIG. 37) connected to the two upper strap receivers 120 or any other configuration as desired. The straps 130, 131 therefore have connection portions 132 configured to engage the strap receivers 120.

Figure 8:
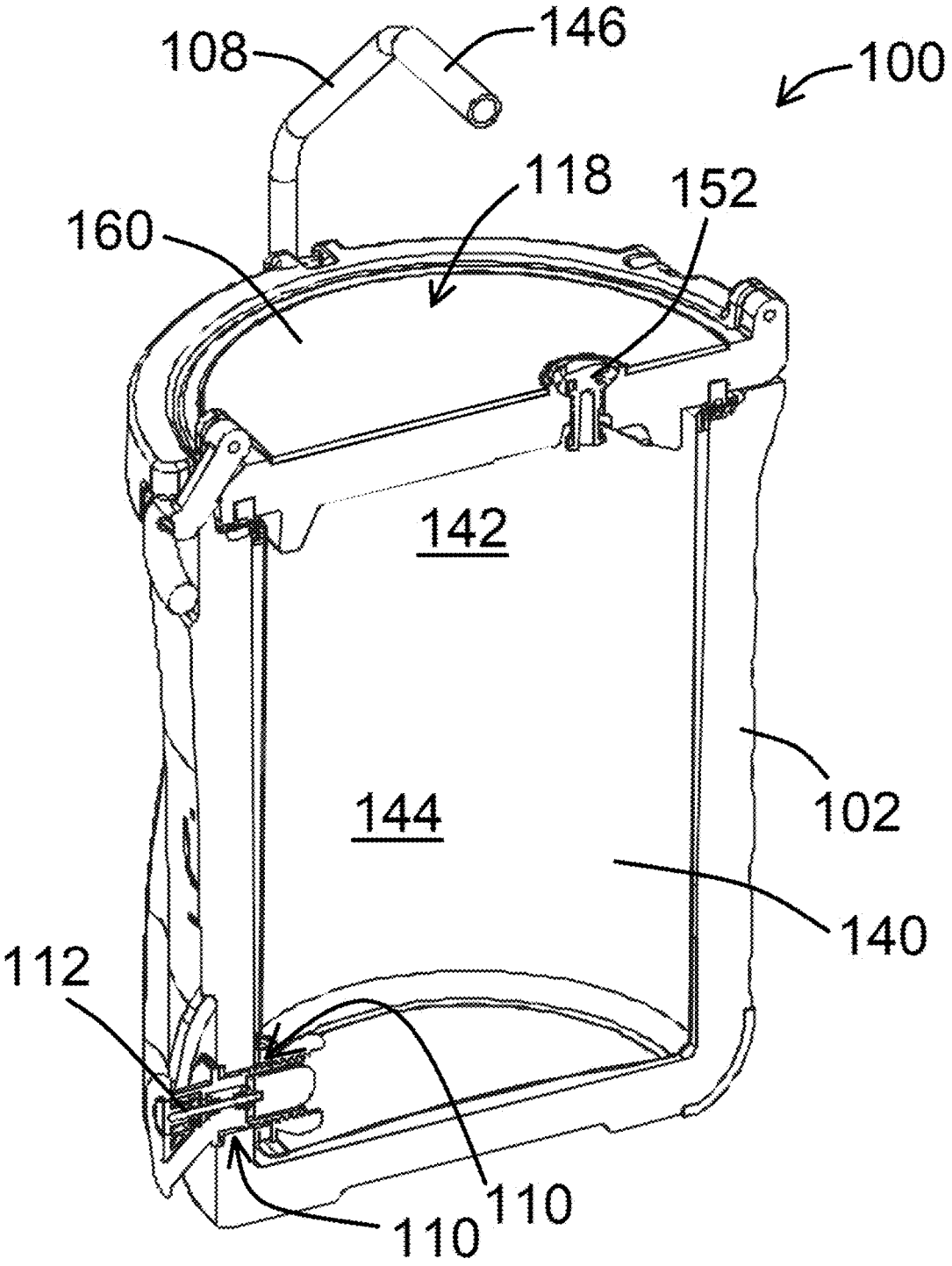
FIG. 8 shows a perspective cutaway view of the cooler of FIG. 1, according to an exemplary embodiment of the present disclosure.
Figure 9:
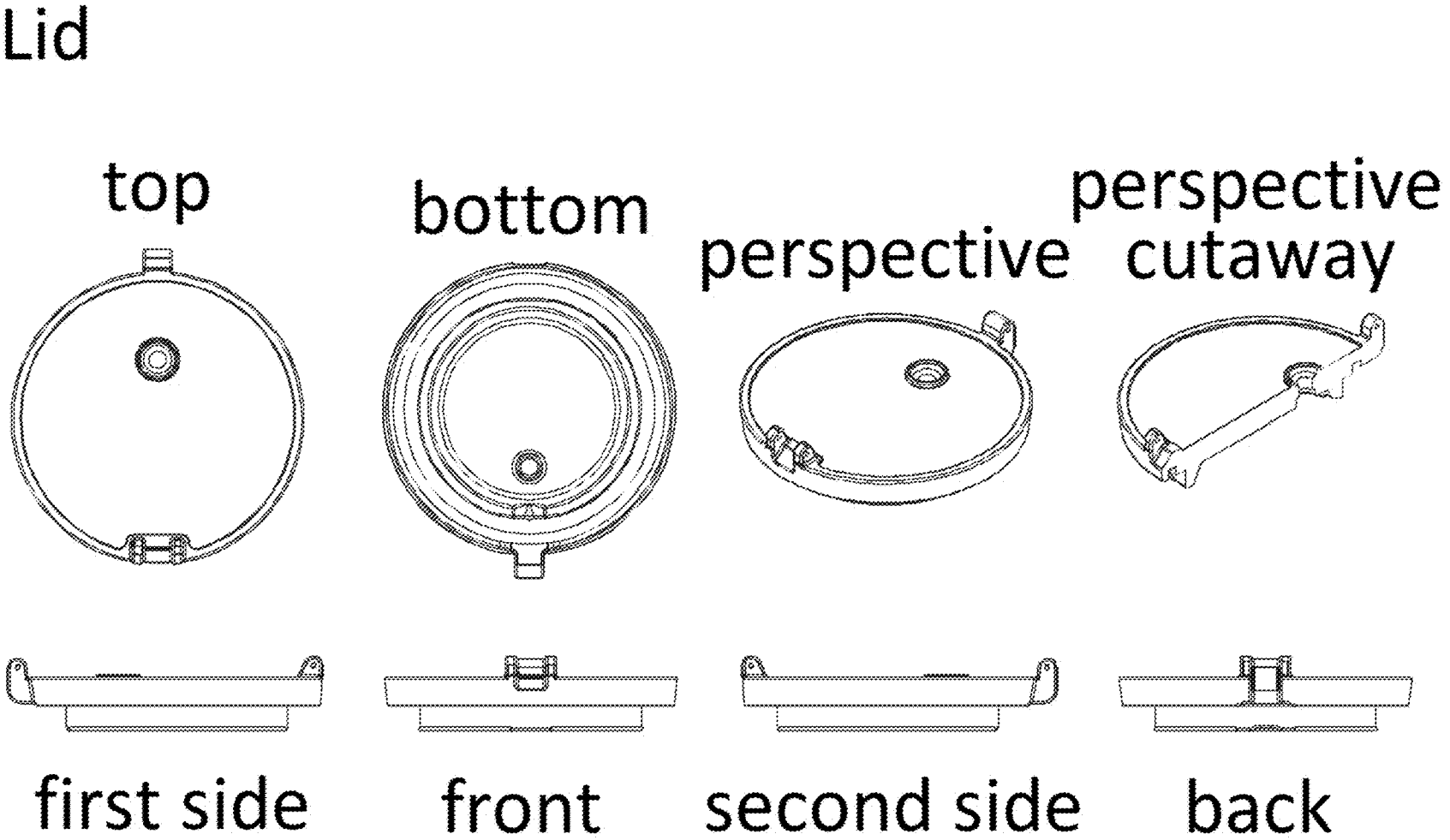
FIG. 9 shows multiple views of a cooler lid, according to an exemplary embodiment of the present disclosure.
Figure 10:
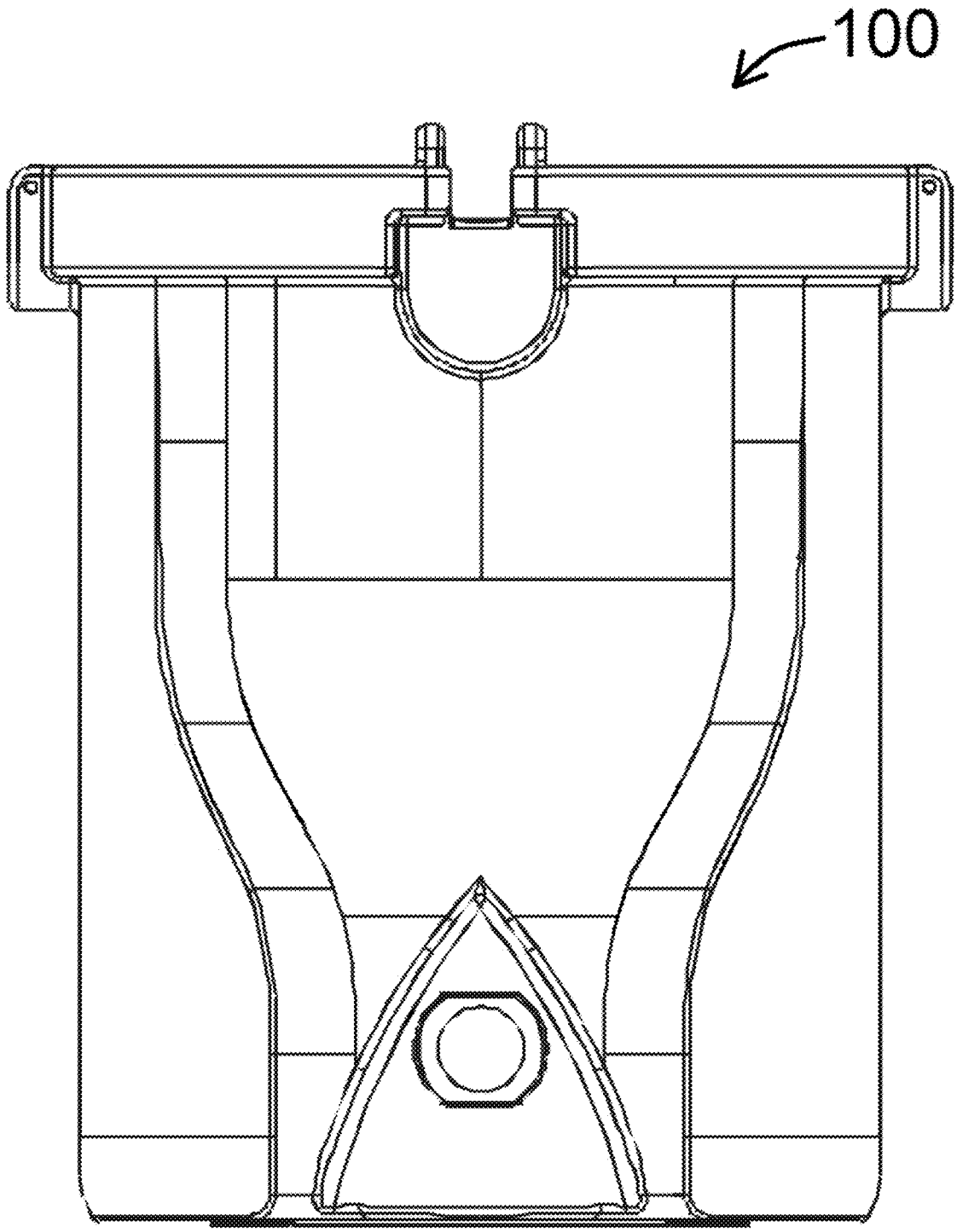
FIG. 10 shows a front view of a cooler with no lid, no handle, and no feet shown, according to an exemplary embodiment of the present disclosure.
Figure 11:
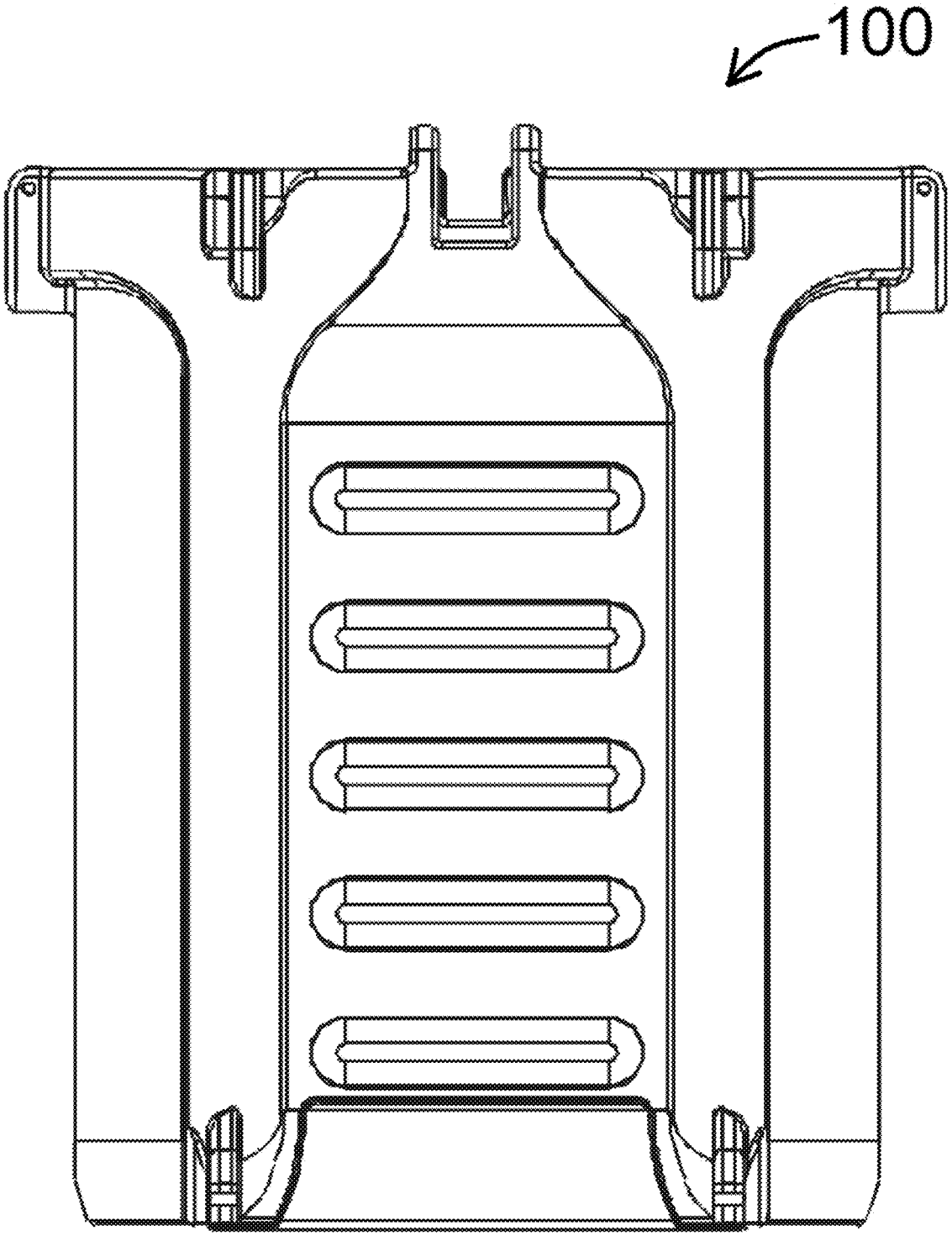
FIG. 11 shows a back view of the cooler of FIG. 10, according to an exemplary embodiment of the present disclosure.
Figure 12:
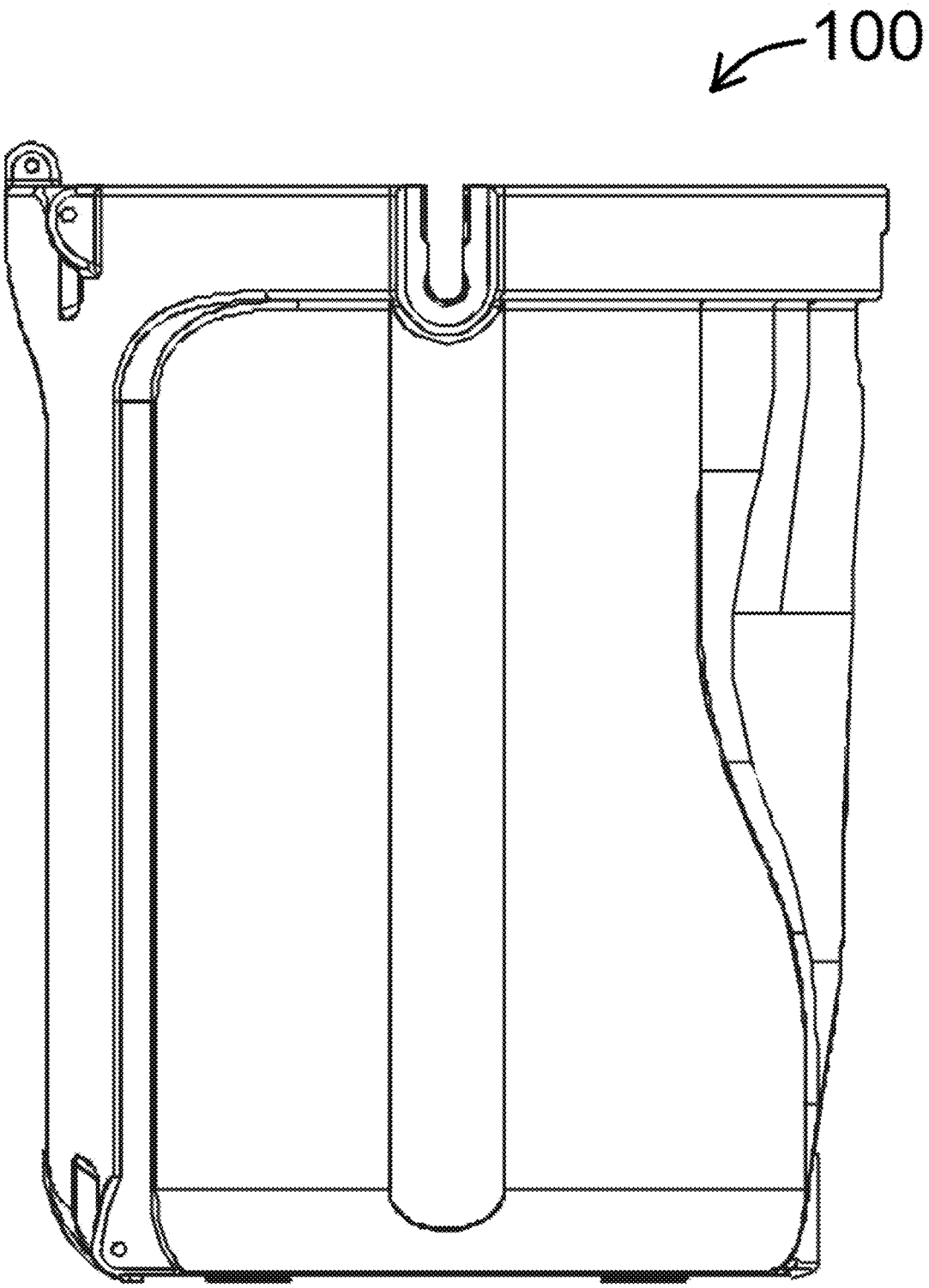
FIG. 12 shows a first side view of the cooler of FIG. 10, according to an exemplary embodiment of the present disclosure.
Figure 13:
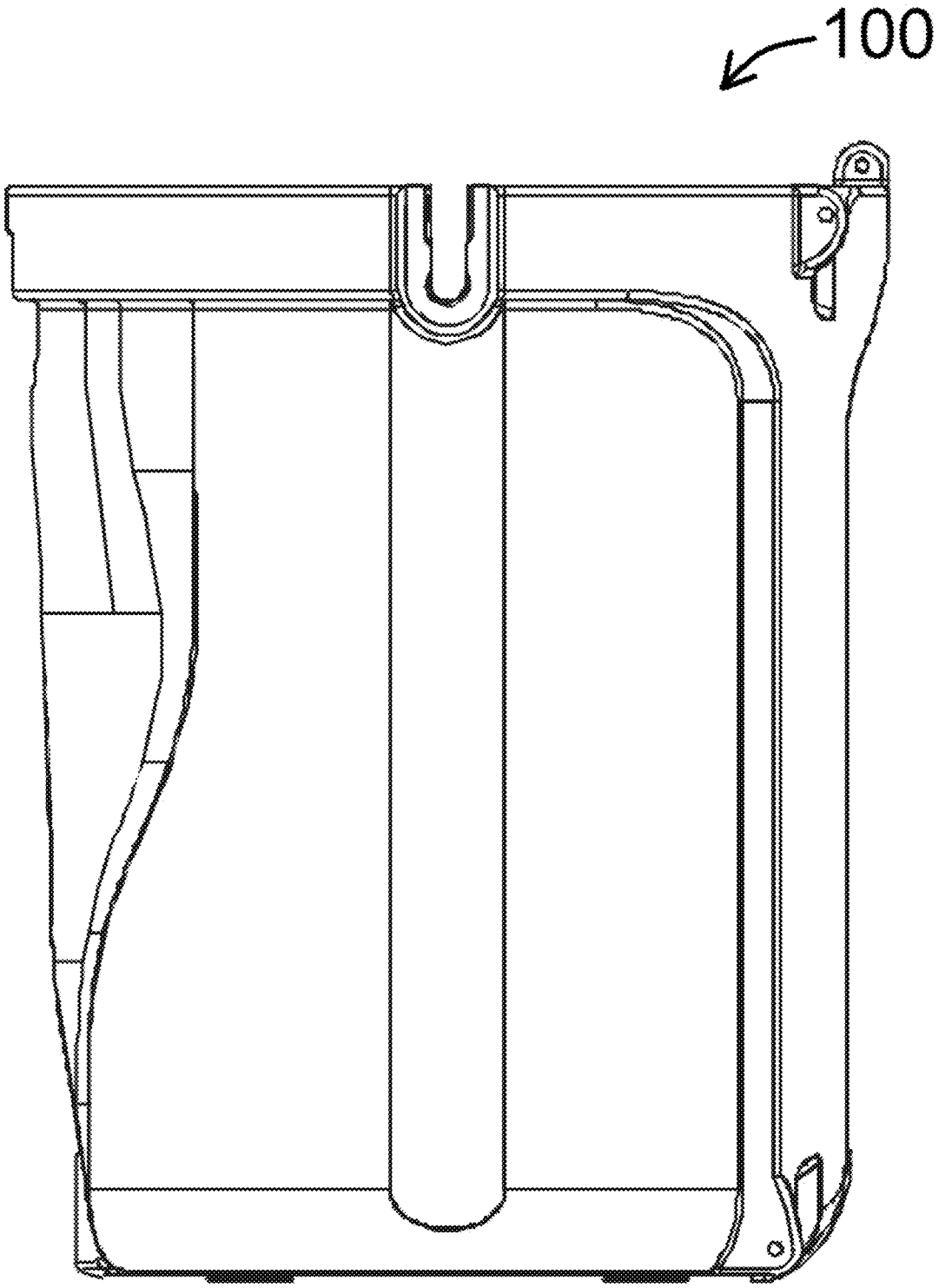
FIG. 13 shows a second side view of the cooler of FIG. 10, according to an exemplary embodiment of the present disclosure.
Figure 14:
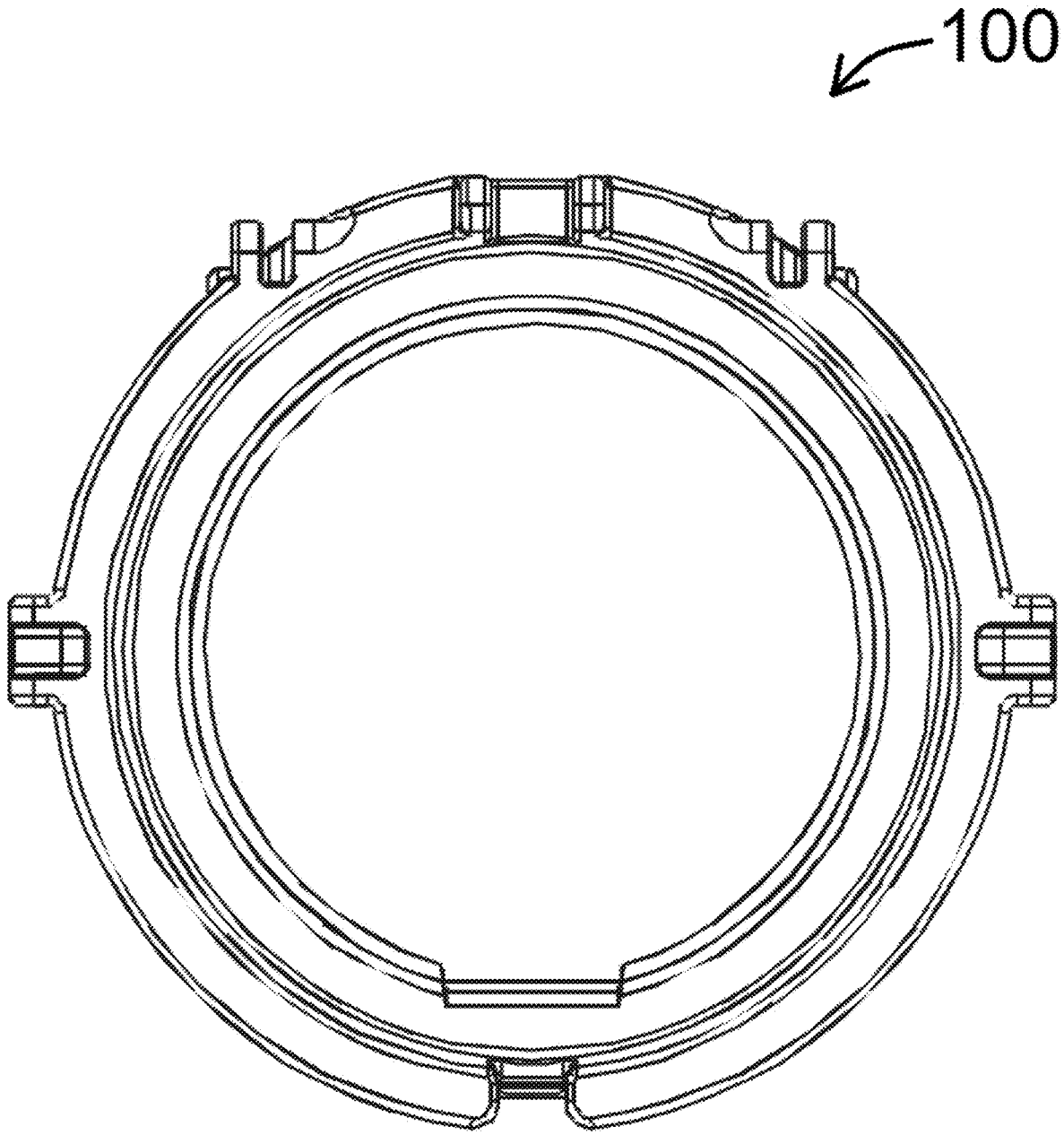
FIG. 14 shows a top view of the cooler of FIG. 10, according to an exemplary embodiment of the present disclosure.
Figure 15:
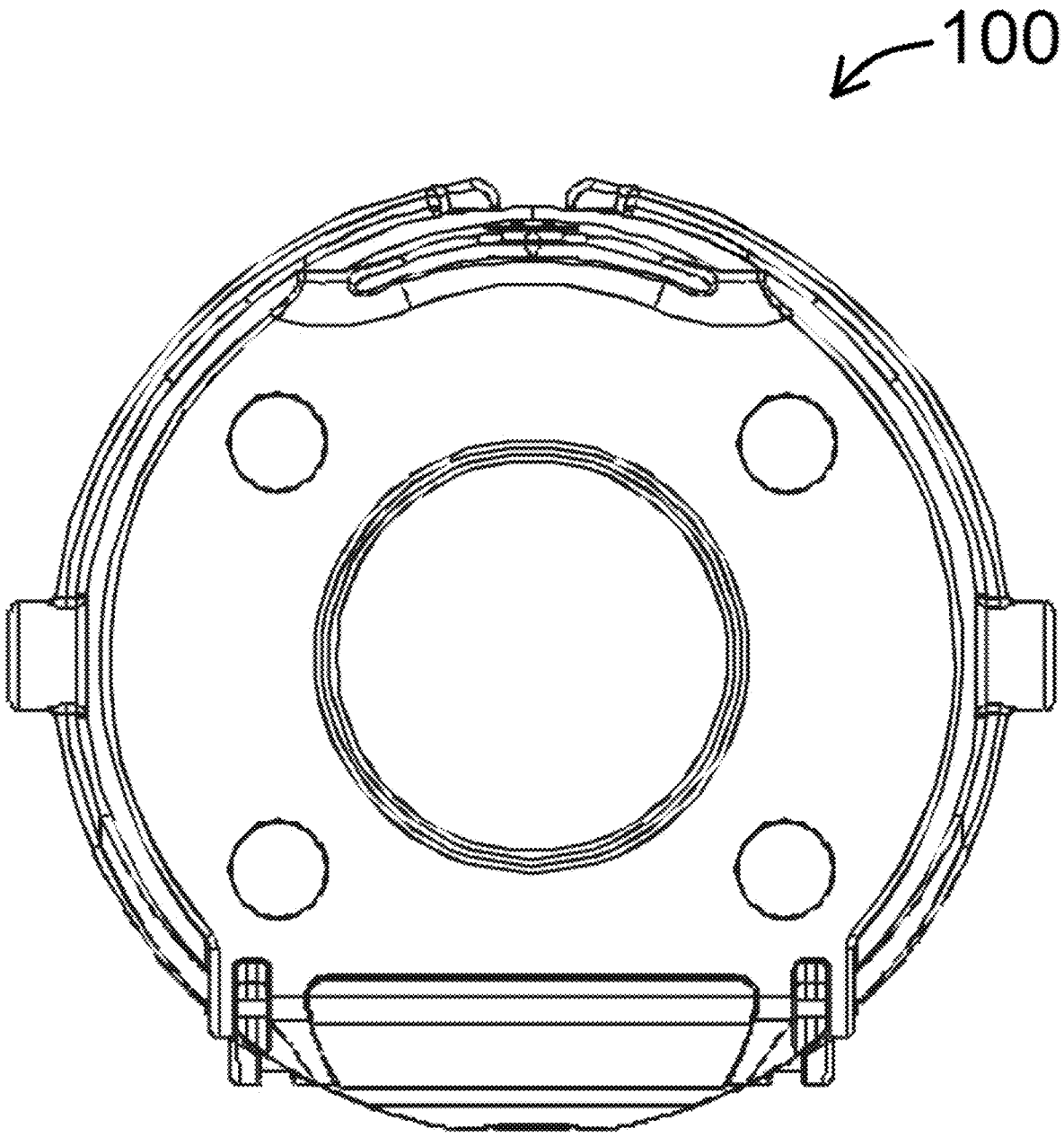
FIG. 15 shows a bottom view of the cooler of FIG. 10, according to an exemplary embodiment of the present disclosure.
Figure 16:
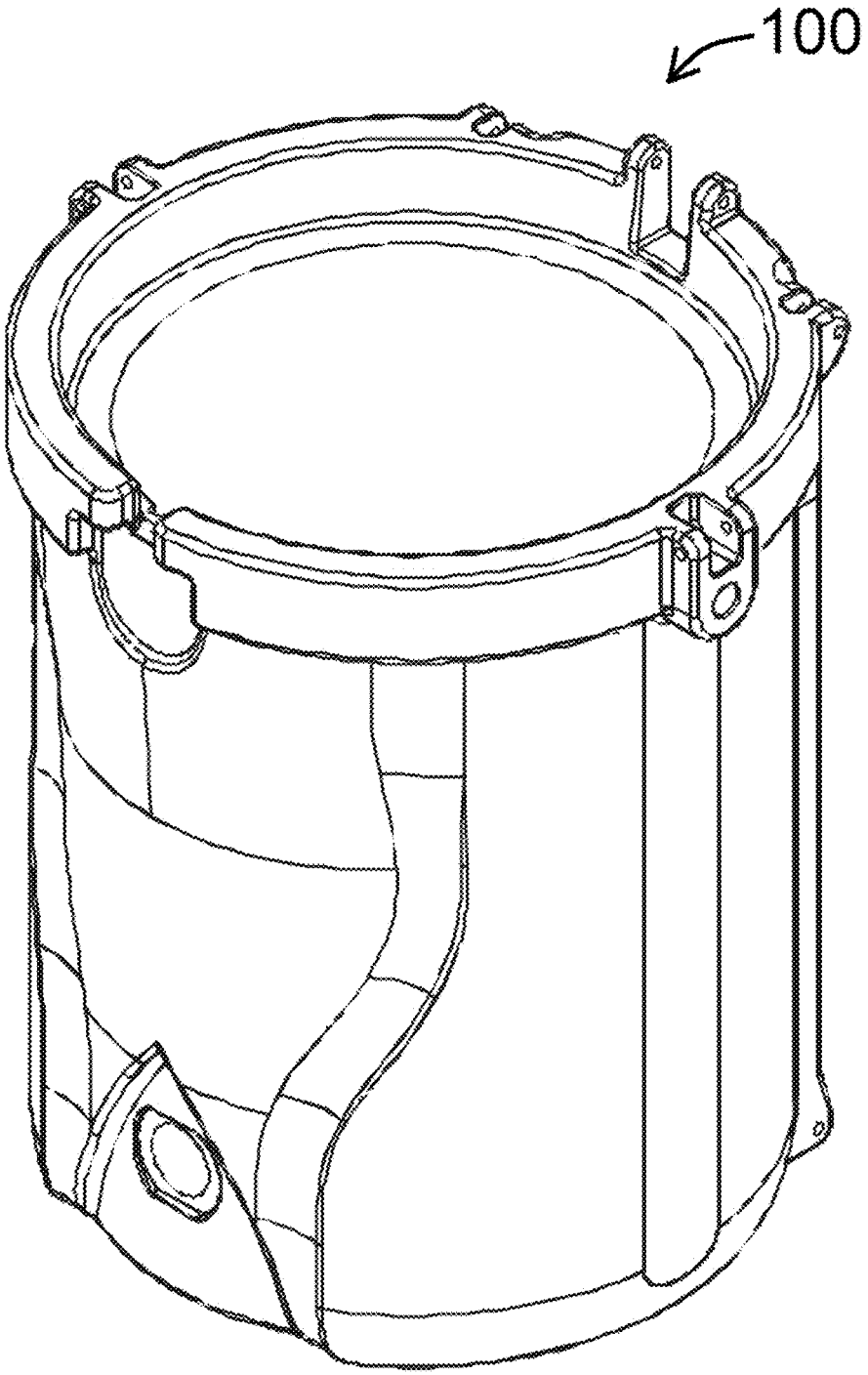
FIG. 16 shows a perspective view of the cooler of FIG. 10, according to an exemplary embodiment of the present disclosure.
Figure 17:
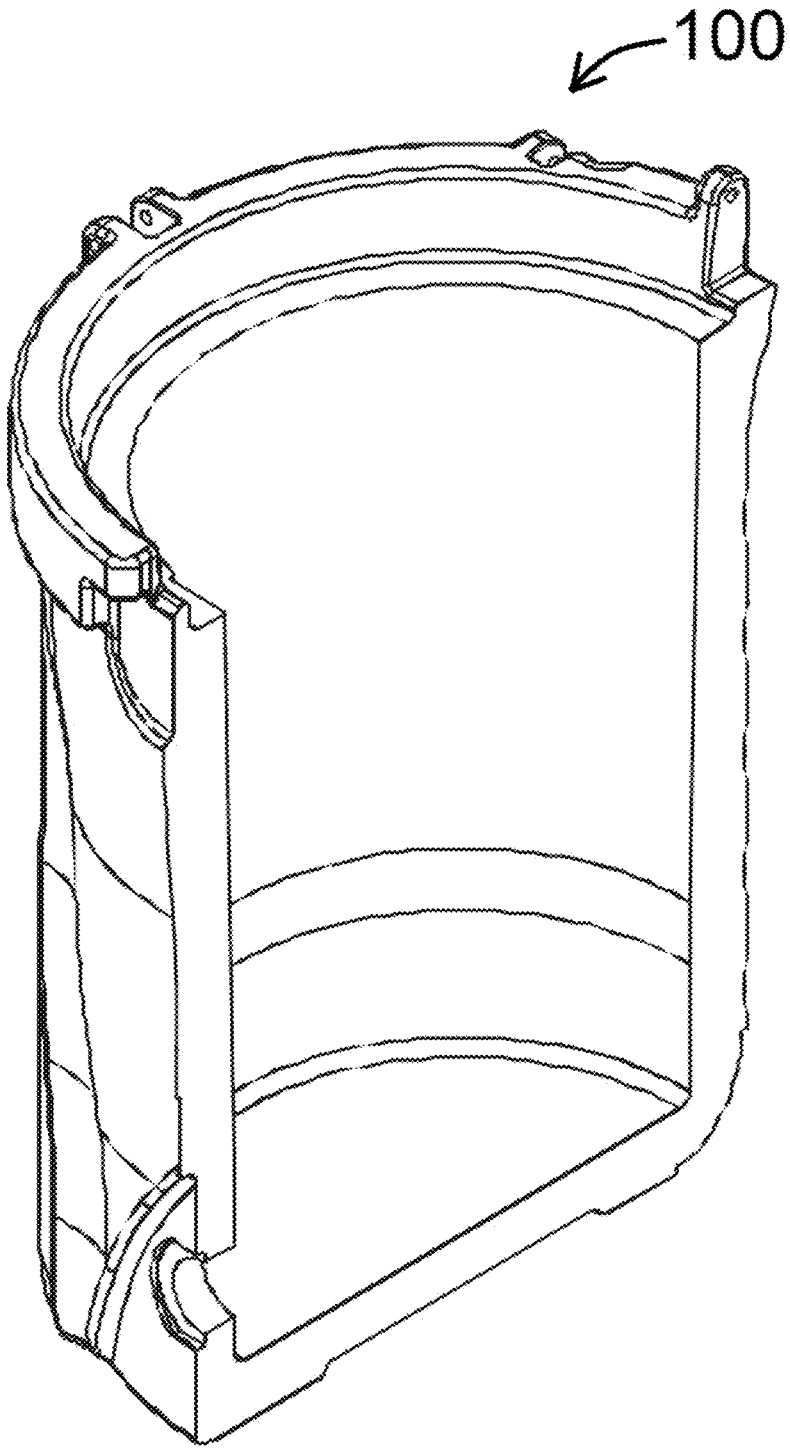
FIG. 17 shows a perspective cutaway view of the cooler of FIG. 10, according to an exemplary embodiment of the present disclosure.
Figure 18:
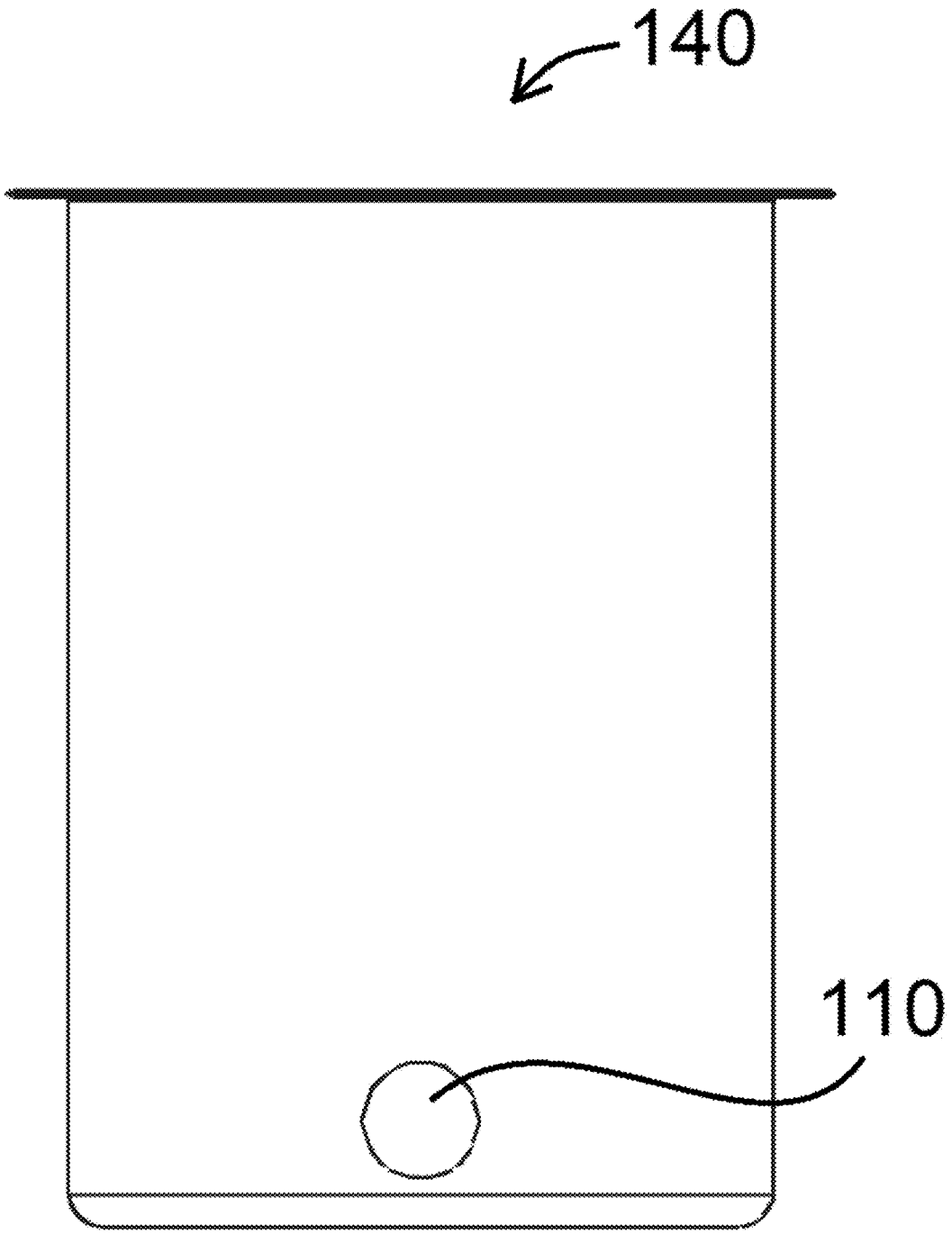
FIG. 18 shows a front view of a metal insert for a cooler, according to an exemplary embodiment of the present disclosure.
Figure 19:
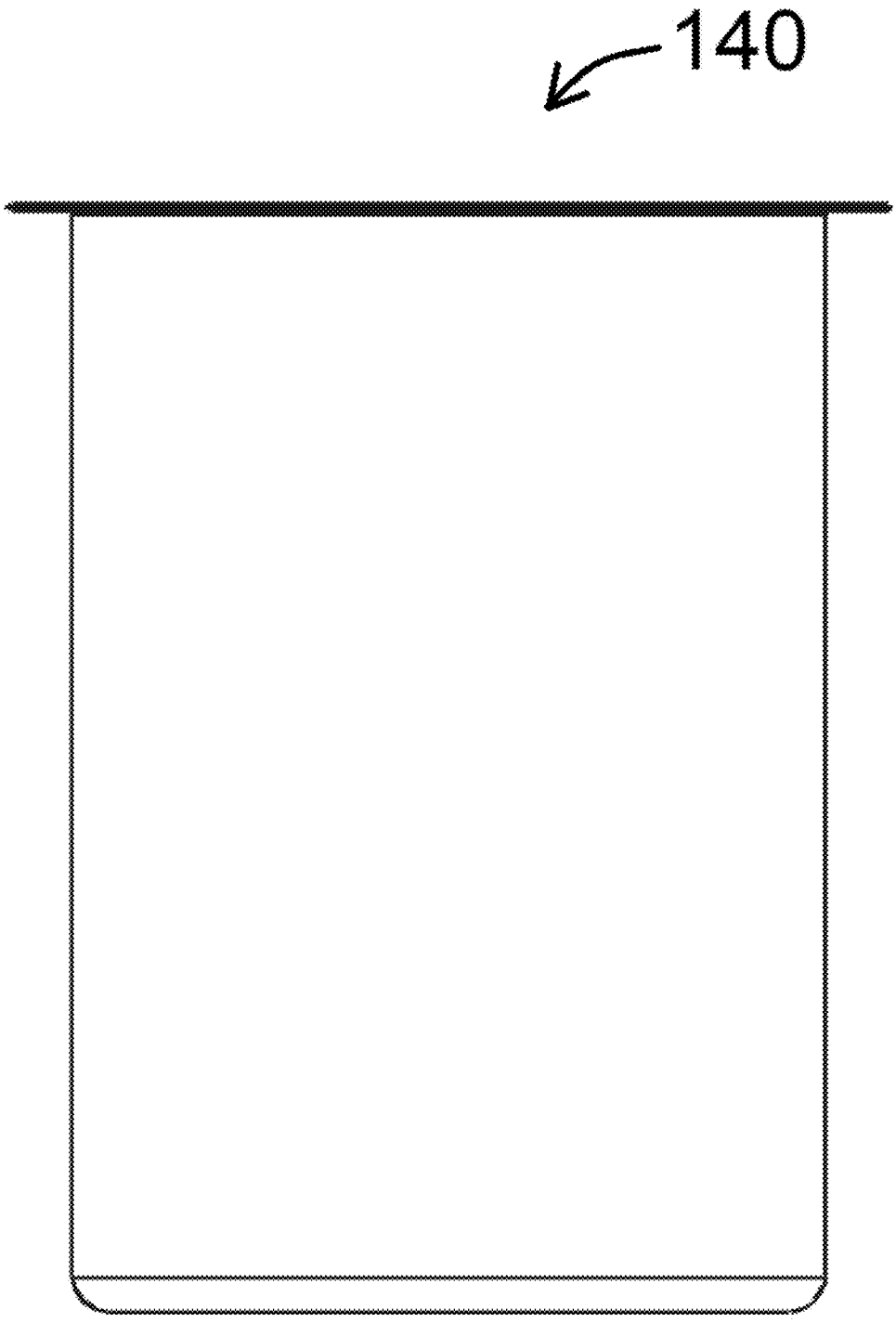
FIG. 19 shows a back view of the cooler of FIG. 18, according to an exemplary embodiment of the present disclosure.
Figure 20:
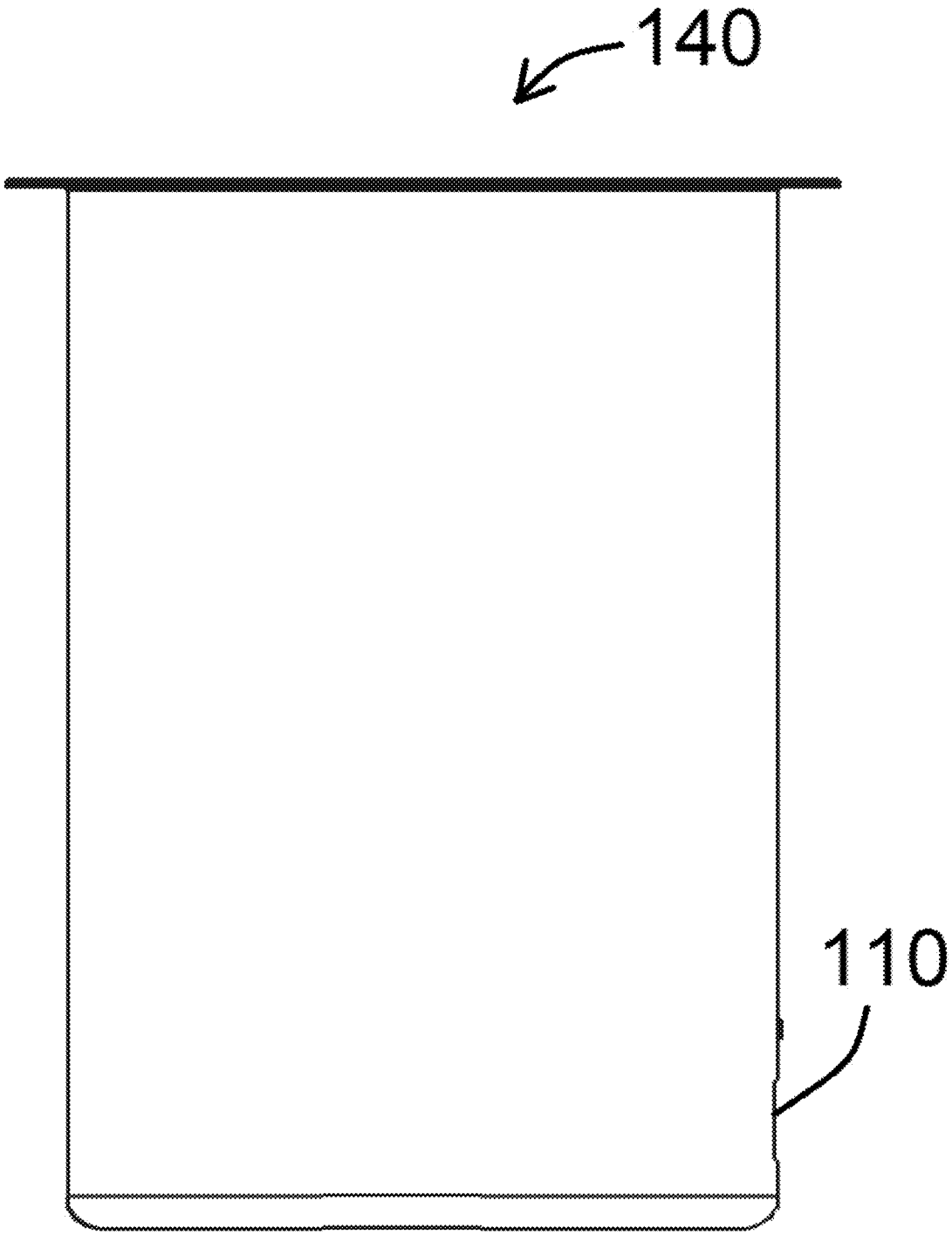
FIG. 20 shows a first side view of the metal insert of FIG. 18, according to an exemplary embodiment of the present disclosure.
Figure 21:
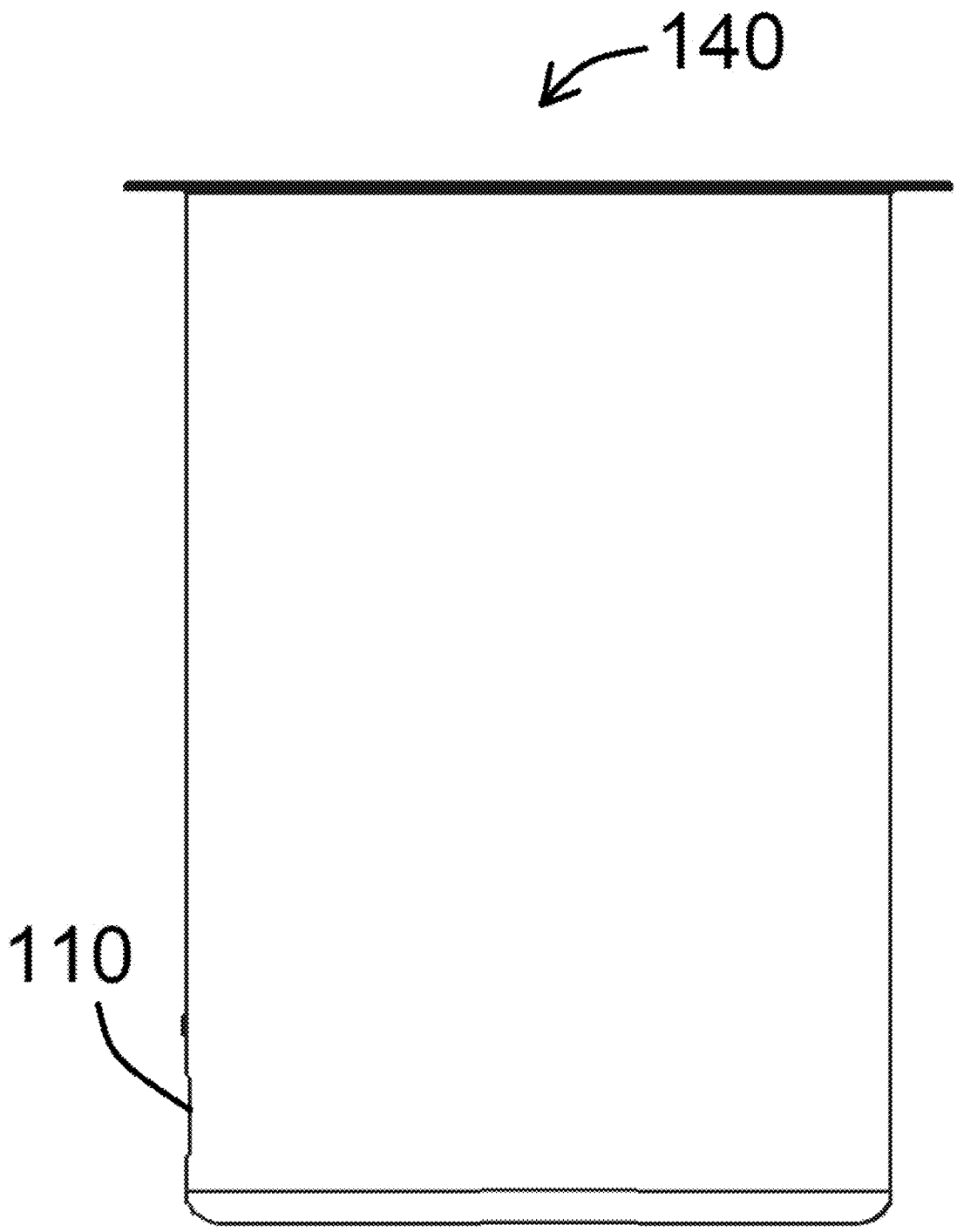
FIG. 21 shows a second side view of the metal insert of FIG. 18, according to an exemplary embodiment of the present disclosure.
Figure 22:
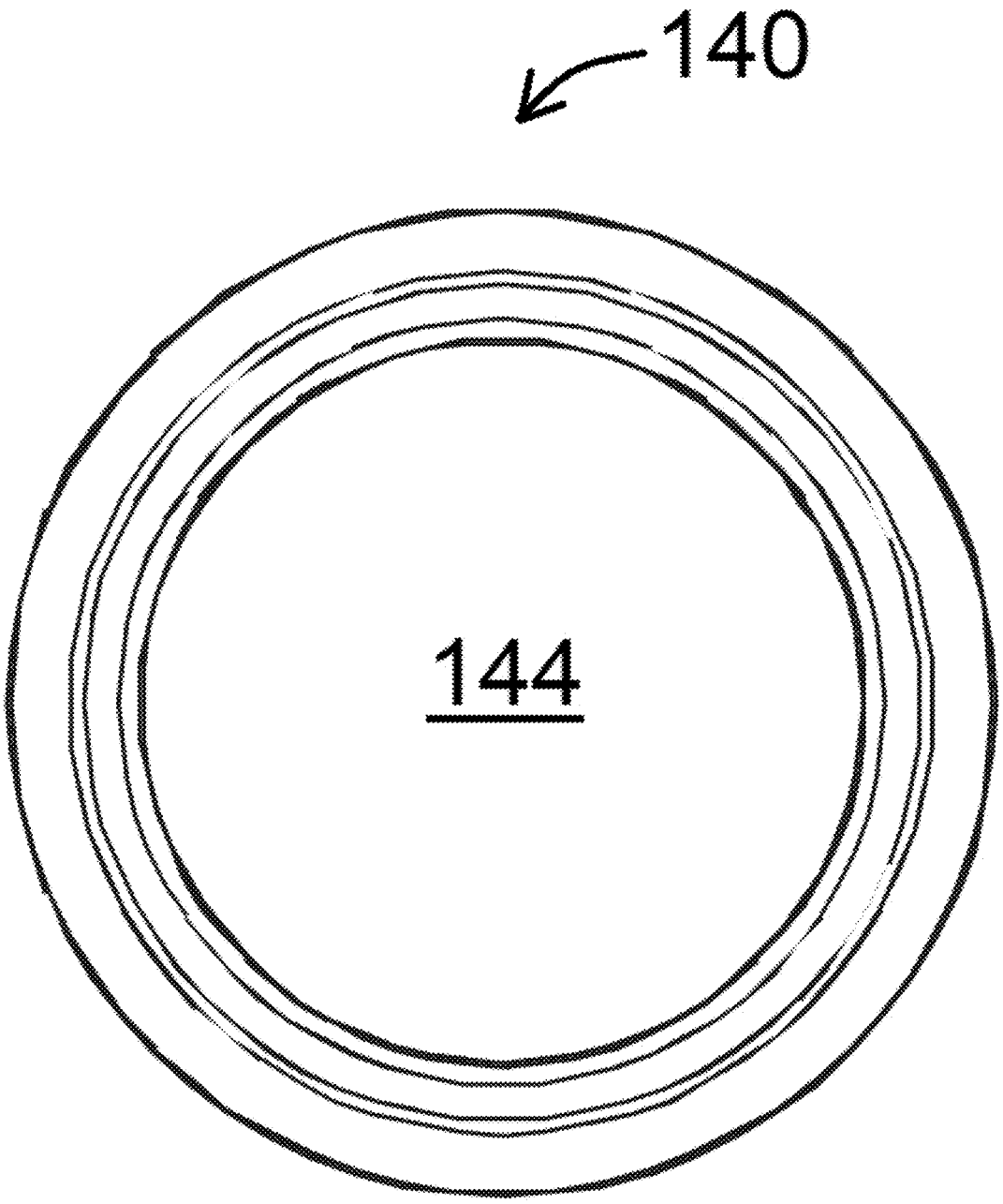
FIG. 22 shows a top view of the metal insert of FIG. 18, according to an exemplary embodiment of the present disclosure.
Figure 23:
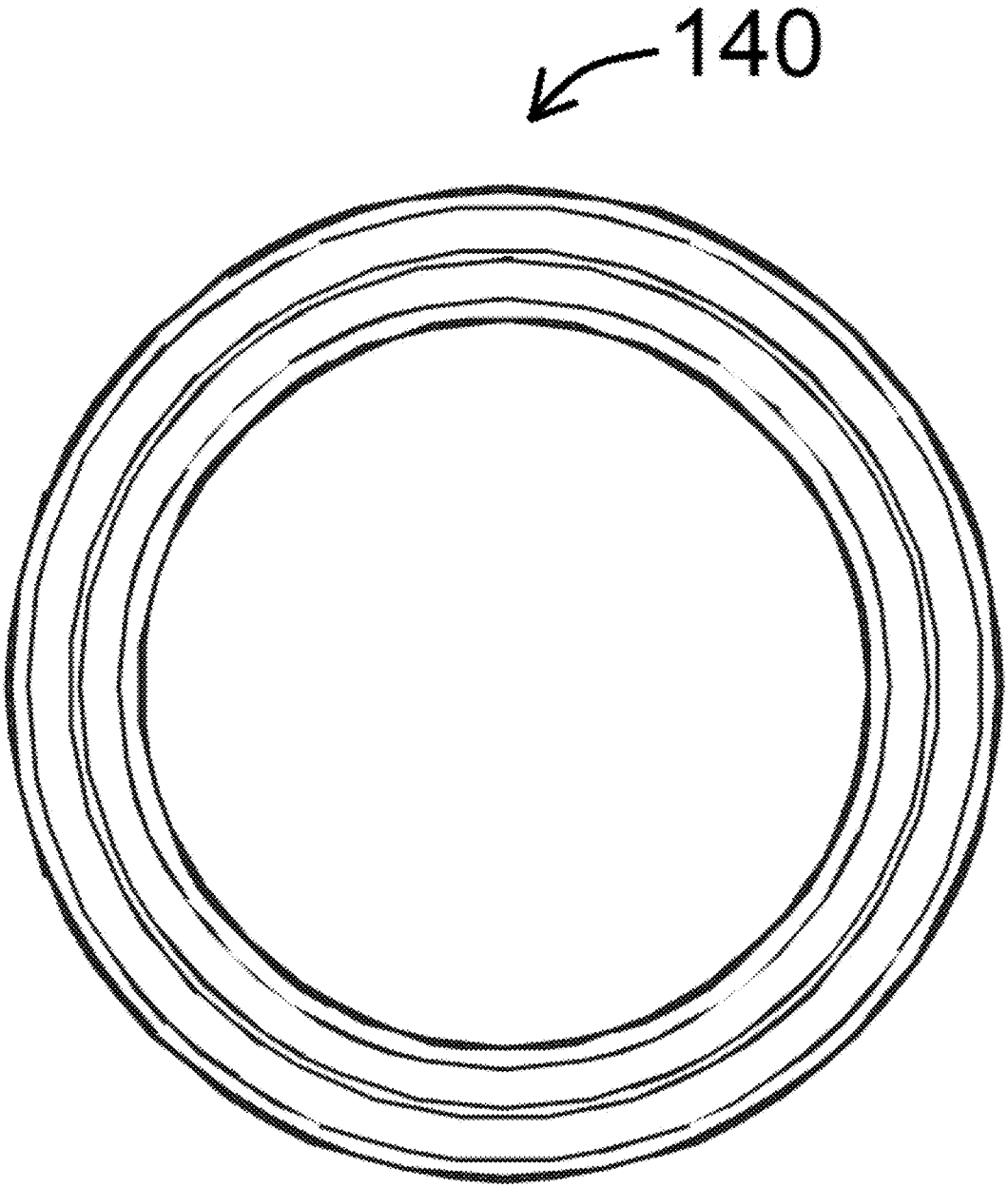
FIG. 23 shows a bottom view of the metal insert of FIG. 18, according to an exemplary embodiment of the present disclosure.
Figure 24:
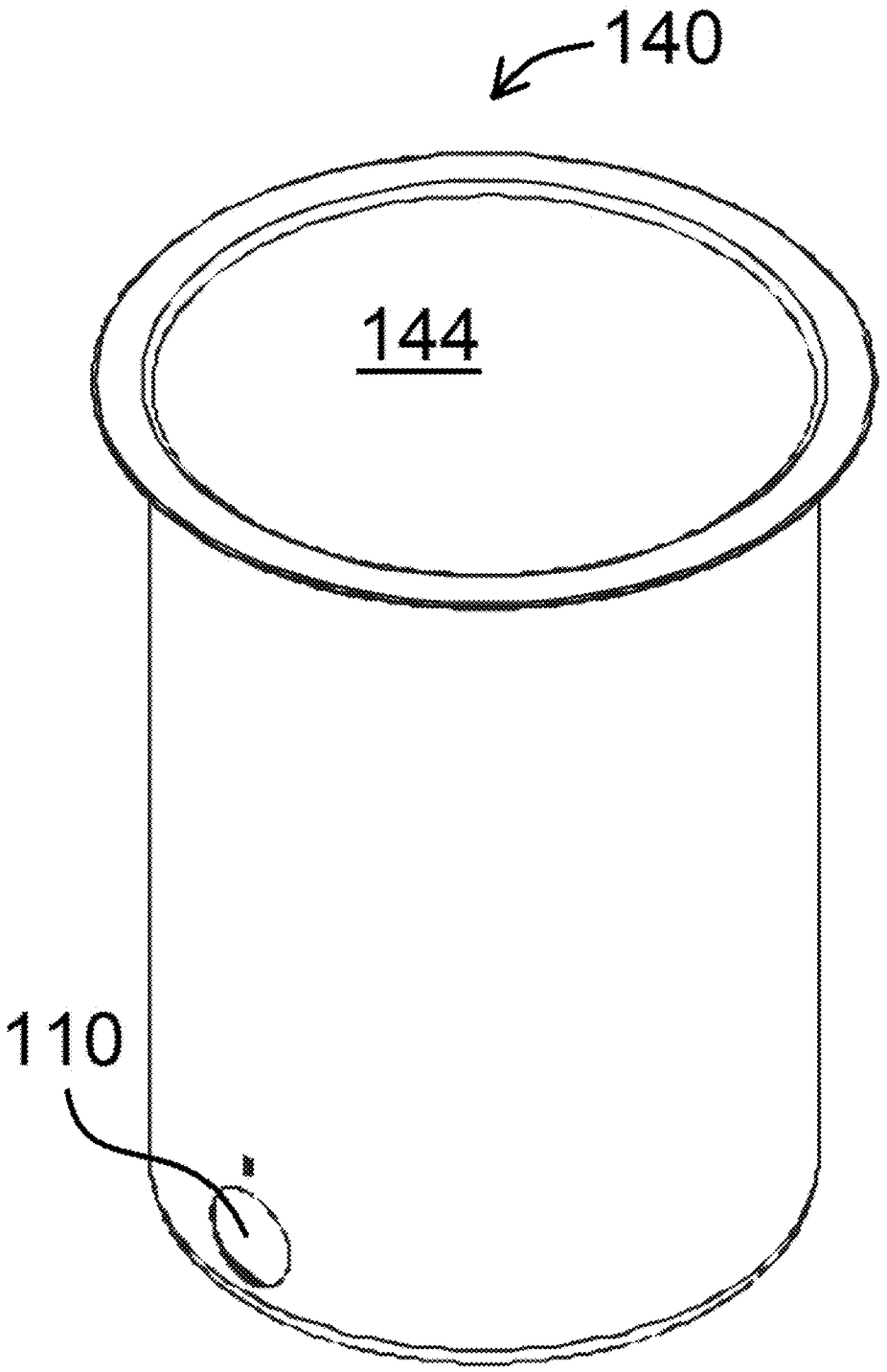
FIG. 24 shows a perspective view of the metal insert of FIG. 18, according to an exemplary embodiment of the present disclosure.
Figure 25:
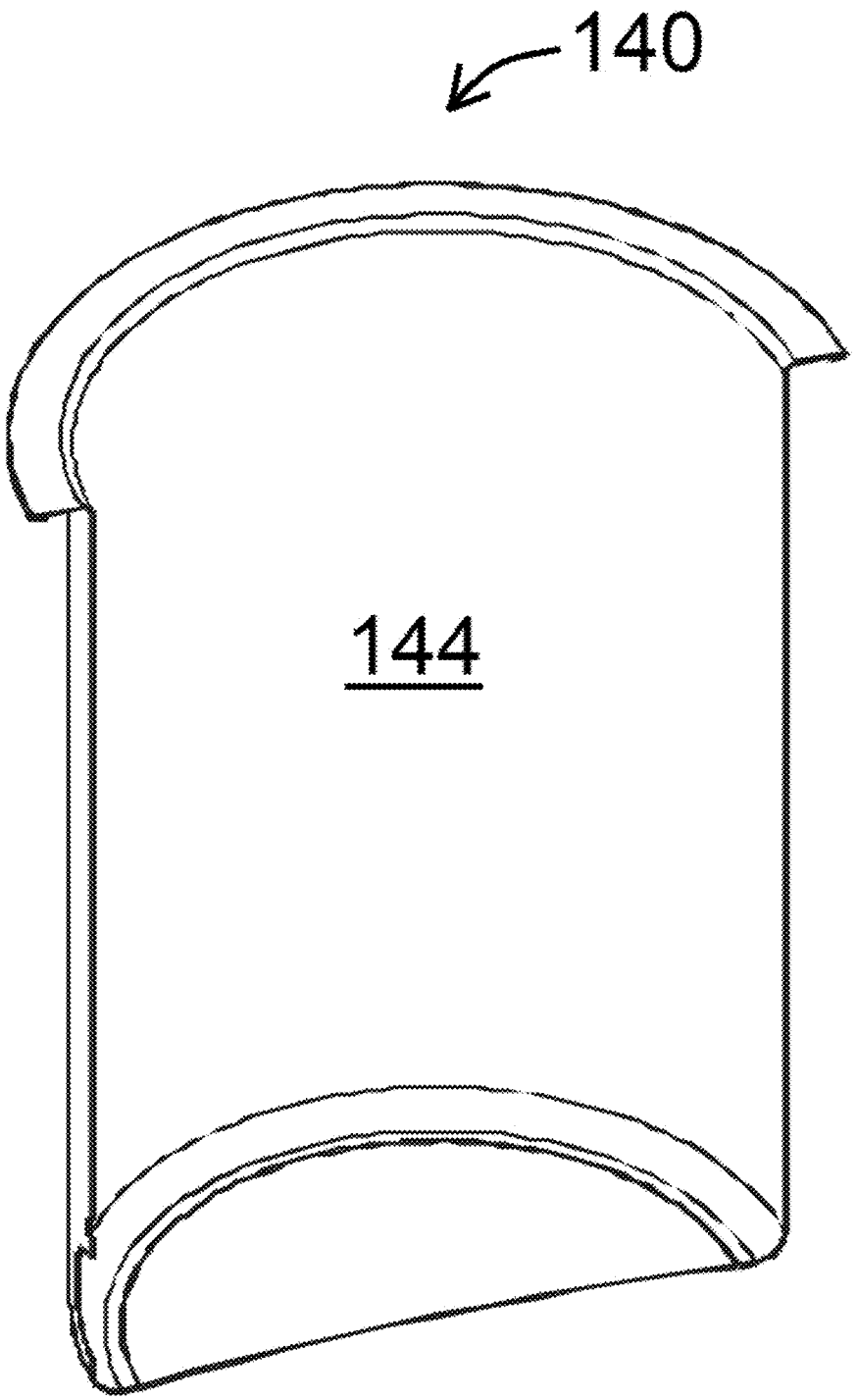
FIG. 25 shows a perspective cutaway view of the metal insert of FIG. 18, according to an exemplary embodiment of the present disclosure.
Figure 26:
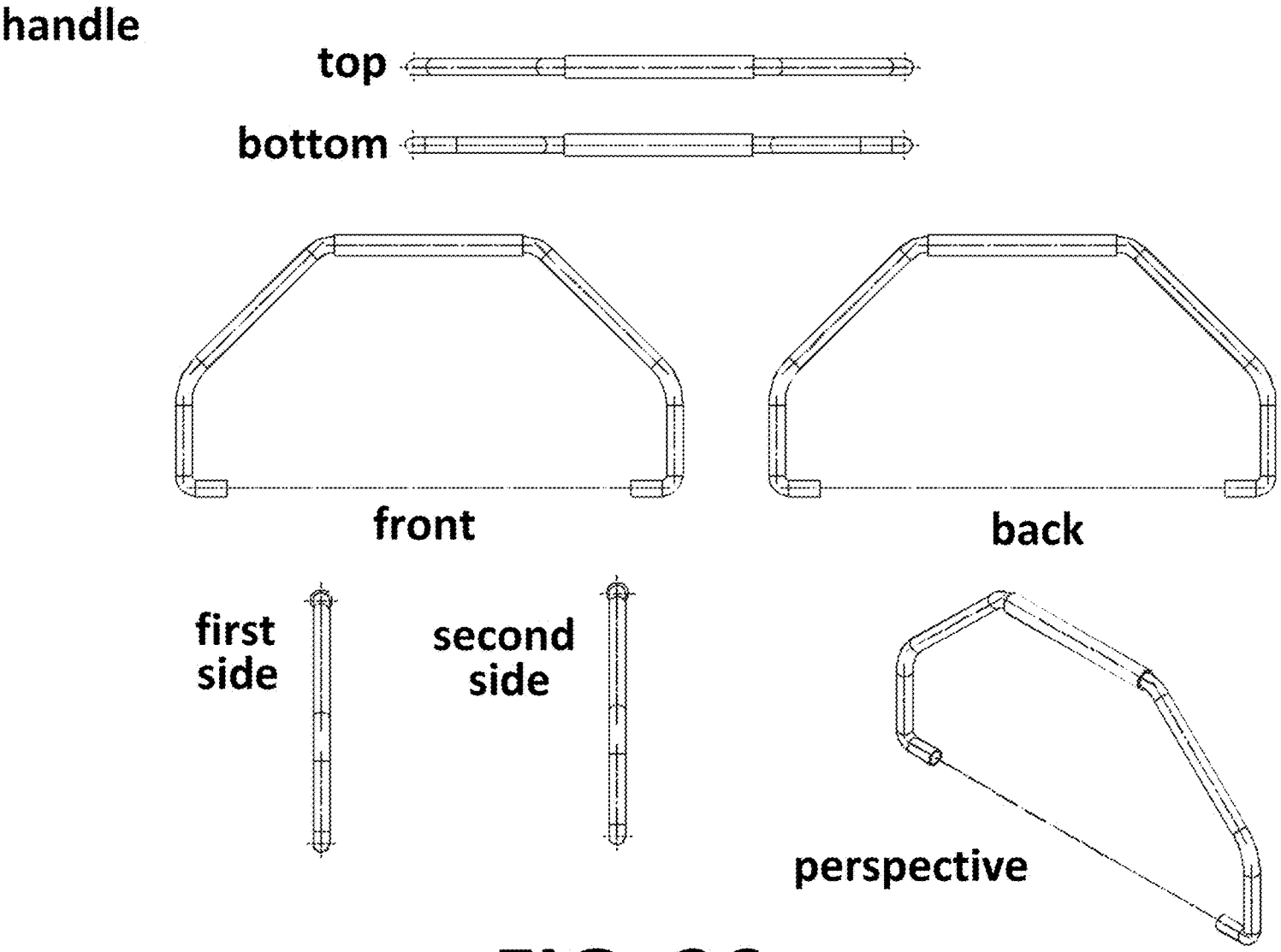
FIG. 26 shows multiple views of a cooler handle, according to an exemplary embodiment of the present disclosure.

Exemplary coolers 100 of the present disclosure can also comprise an insert 140 positioned in a relative inside 142 of the cooler 100, such as shown in FIG. 8. Insert 140, such as also shown in FIGS. 18-25 separate from cooler 100, can be made of any number of materials, such as plastic or any number of metals, including, but not limited to, stainless steel, aluminum, or another metal or allow, noting that, for example, stainless steel is preferred as it is easy to clean, resists staining, resists discoloration, and is very durable. The use of insert 140 also inhibits the growth of bacteria thereon as compared to a plastic substrate, for example, and allows for easy cleaning/washing. Inserts 140 of the present disclosure can have a relatively cylindrical shape, such as also shown in FIGS. 18-25. Inserts 140 would also have a tap aperture 110 formed or defined therethrough configured to receive at least part of a tap 112 therethrough, permitting a liquid present within the inside 144 of insert 140 to be dispensed through tap 112 into a cup, for example. Insert 140, in various embodiments, is removable from cooler 100.

Handle 108, as referenced herein, is configured to swivel from front to back to front so to allow a user to carry the cooler 100 with his or her hand by grasping said handle 108. A comfort grip 146, such as shown in FIGS. 1-4, can be made of a spongy or otherwise resilient material, and can be placed upon handle 108. Handle 108 can be made of metal as well to be durable, such as being made of stainless steel or another metal or alloy as otherwise referenced herein.

Cooler 100 embodiments of the present disclosure are leak proof. The tap 112 (also referred to as a spigot) is designed not to drip, and the lid 118 is designed along with the cooler 100 (outer shell 102) to provide a leak proof seal therebetween.

Exemplary coolers 100 of the present disclosure are small enough to be used at most tracks and events, and is big enough to carry most everything needed for a day of fun.

Coolers 100 of the present disclosure are designed to keep beverages cold, such as cooling and/or maintaining cold beer bottles, beer cans, wine bottles, hard seltzer cans, soda bottles, soda cans, water bottles, juice bottles, and the like. If the beverages are cold when placed inside the cooler, they will remain cold for longer than they would outside of the cooler (exposed to the atmosphere). Ice and/or ice packs can be placed inside the cooler 100 (inside the insert 140) so to keep the beverages cold, make warm beverages cold, and make cold beverages even colder, whereby the insulative effect of cooler 100 keeps the ice and/or ice packs frozen.

Different sizes and capacities of coolers 100 of the present disclosure can be prepared. For example, a cooler 100 having a 3 gallon capacity can be made, or having a smaller or larger capacity. A cooler 100 having width dimensions at or between 12-14 inches, and having a height dimension at or between 14-16 inches, or smaller or larger width and/or height dimensions, can be made.

Tap 112 can be handled from the outside of the cooler 100, whereby the inside of the tap 112 is in fluid communication with the inside 144 of the insert 140 (as there is an opening (a tap aperture 110) in the insert 140 to receive at least part of the tap 112 or at least to provide access to the inside 144 of the insert 140 by the tap 112). This configuration allows, for example, ice water, water, a sports beverage, beer, wine, etc., to be transferred from the inside of the cooler 100 (inside 144 the insert 140) to a beverage receptacle via the tap 112 without opening the lid 118 of the cooler 100, for example.

Cooler embodiments of the present disclosure permit drinks to be mixed within insert 140 and then served via the tap 112, as may be desired.

Exemplary coolers 100 of the present disclosure can be carried by the handle 108, via backpack straps 130 connected to or formed as part of the cooler 100, and/or by way of a shoulder strap 131 connected to or formed as part of the cooler 100, such as shown in FIG. 37.

Figure 28:
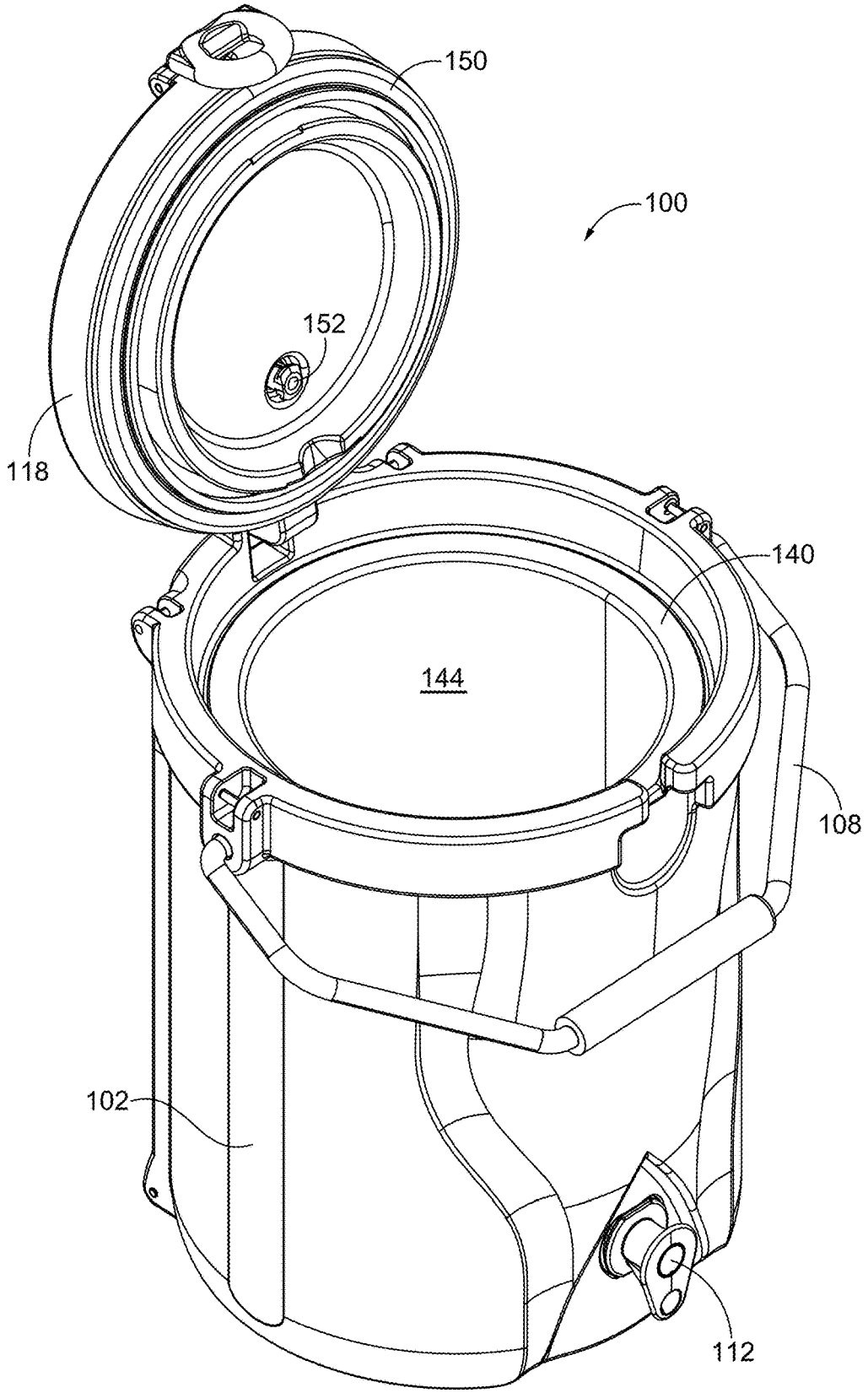
FIG. 28 is a photograph of a cooler in perspective view, with the lid open, the handle swiveled down, the metal insert positioned therein, and with no straps connected thereto, according to an exemplary embodiment of the present disclosure.
Figure 29:
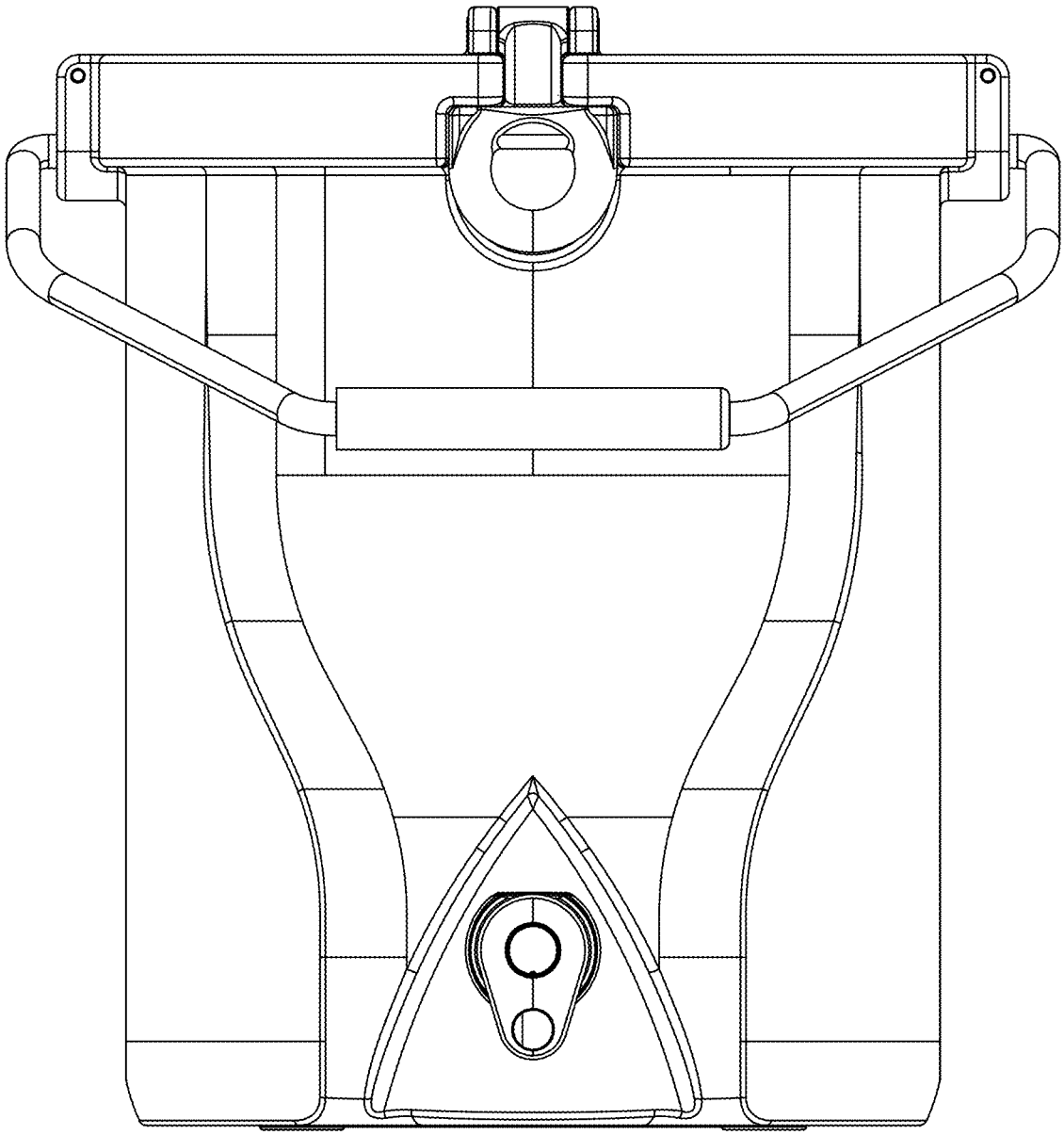
FIG. 29 is a photograph of a front view of a cooler, with the lid secured closed and the handle swiveled down, according to an exemplary embodiment of the present disclosure.
Figure 30:
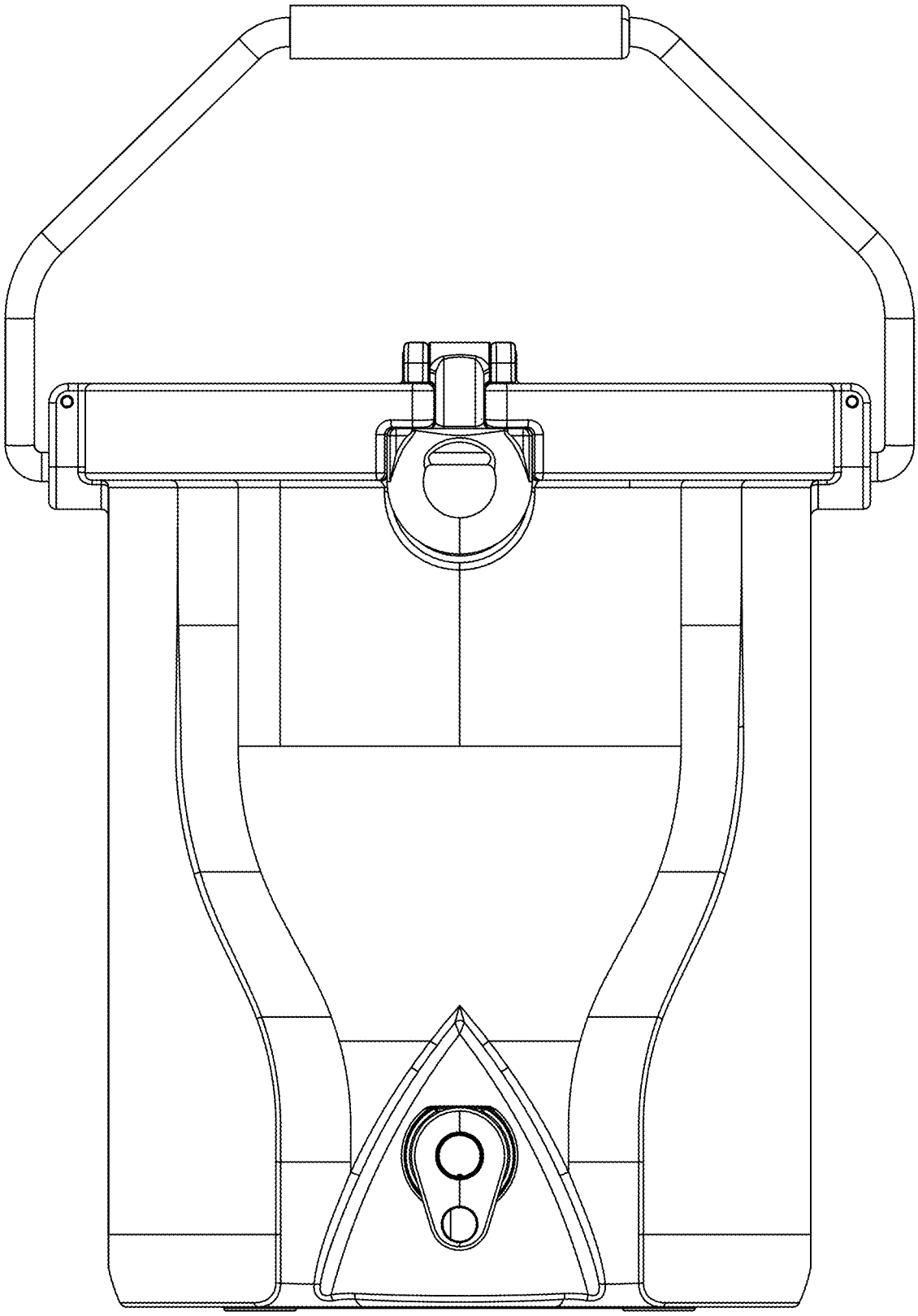
FIG. 30 is a photograph of a photograph of a front view of a cooler, with the lid secured closed and the handle swiveled up, according to an exemplary embodiment of the present disclosure.
Figure 31:
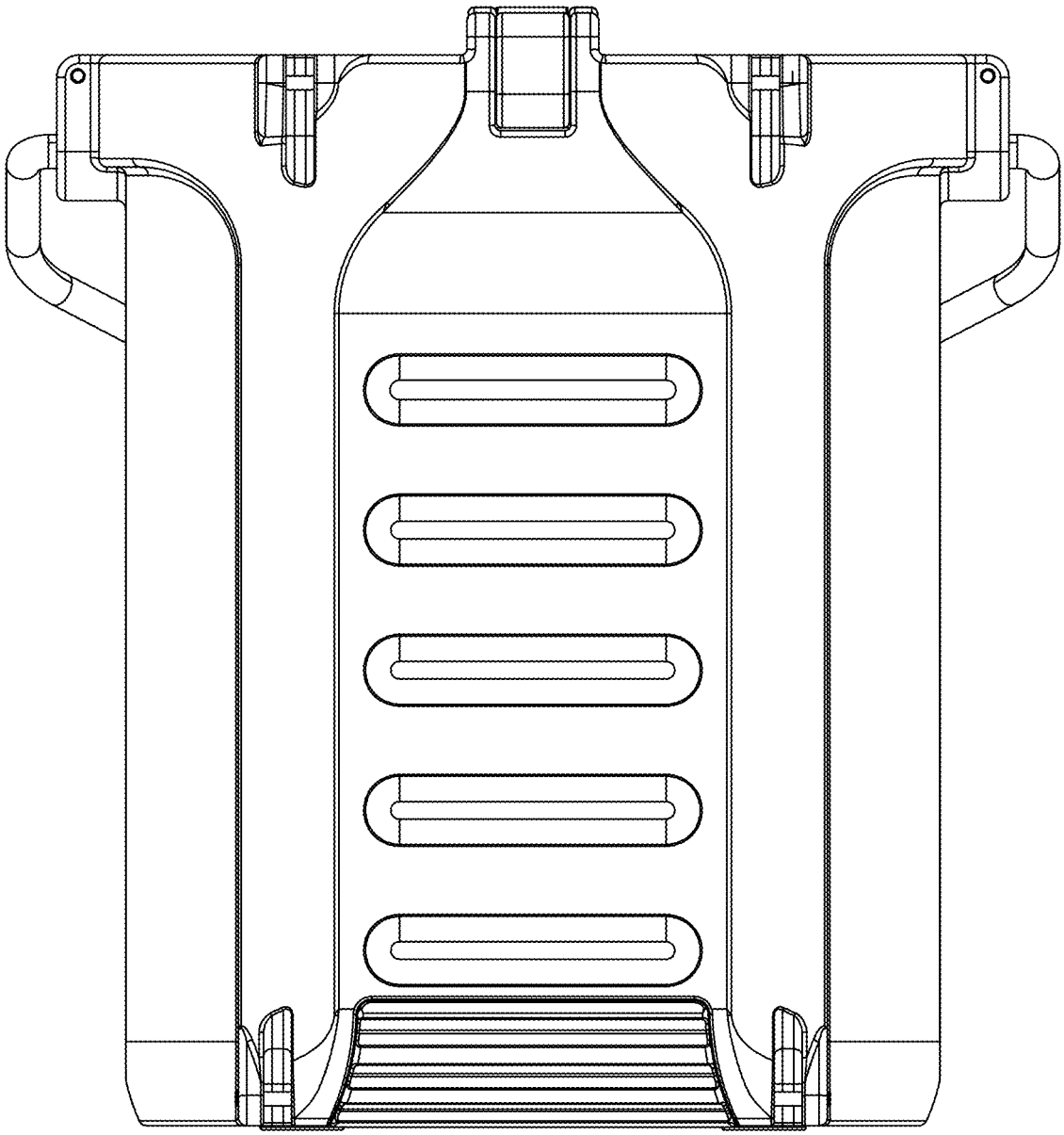
FIG. 31 is a photograph of a back view of a cooler, with the handle swiveled down and with no straps connected thereto, according to an exemplary embodiment of the present disclosure.
Figure 32:
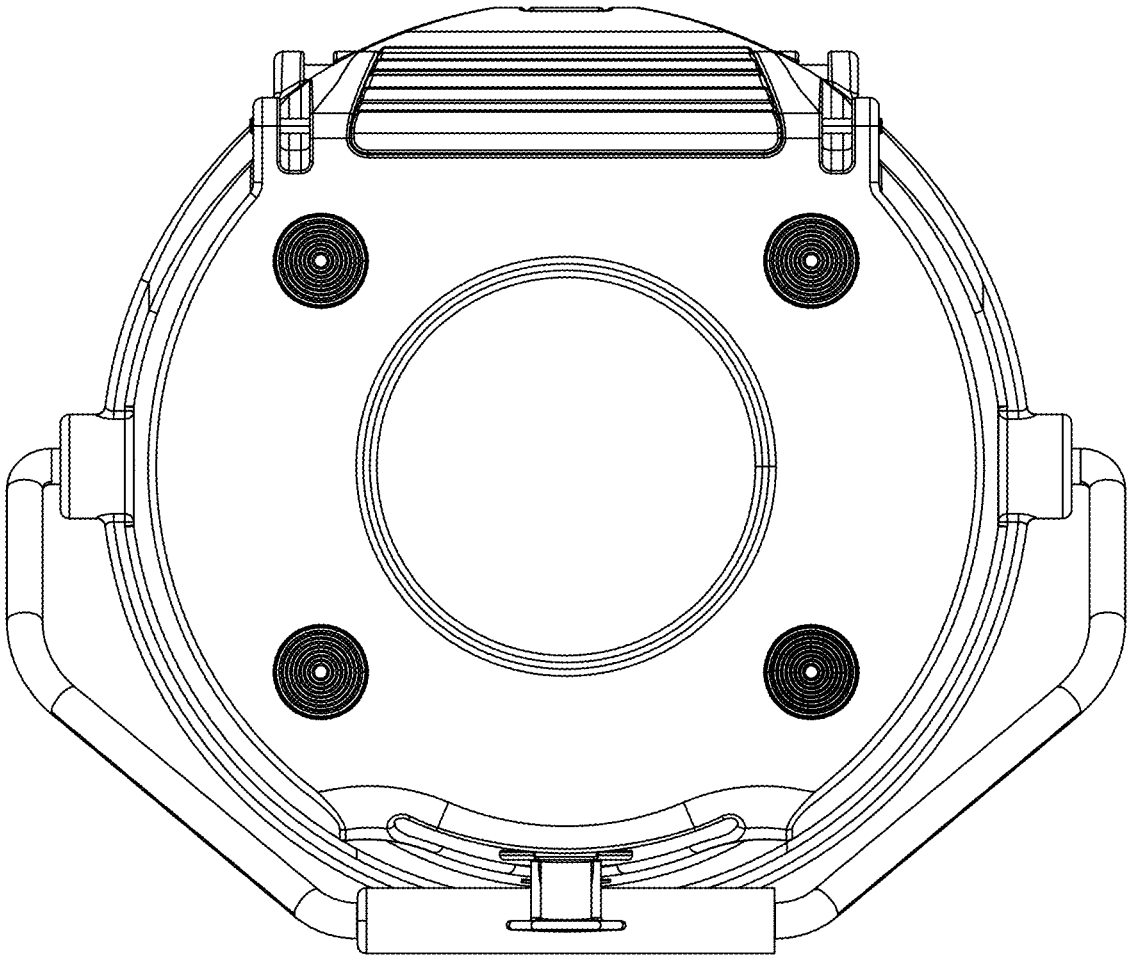
FIG. 32 is a photograph of a bottom of a cooler, with several pliable feet coupled thereto, according to an exemplary embodiment of the present disclosure.
Figure 33:
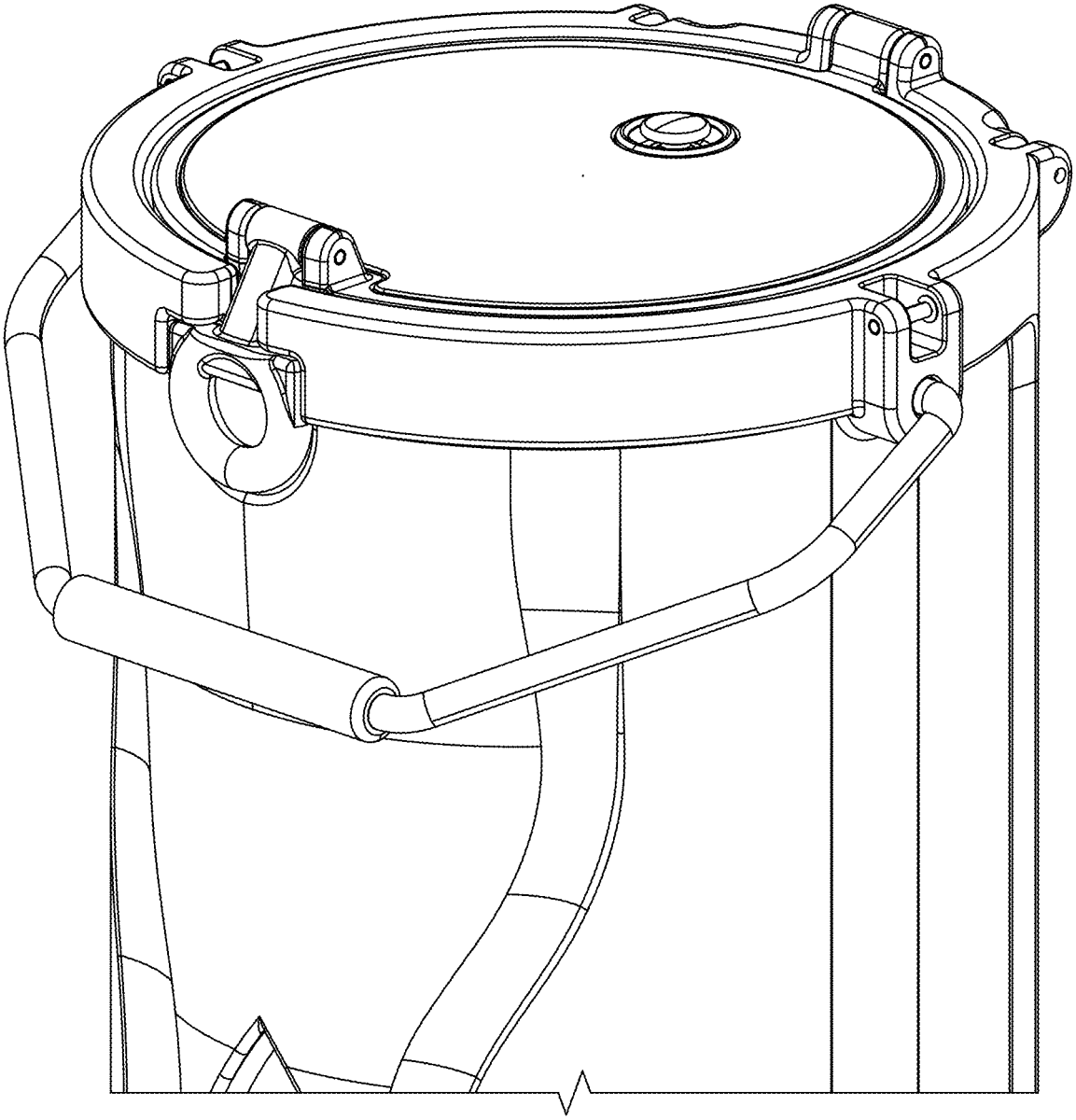
FIG. 33 is a photograph of a perspective view of an upper portion of a cooler, with the lid secured closed and the handle swiveled down, according to an exemplary embodiment of the present disclosure.
Figure 34:
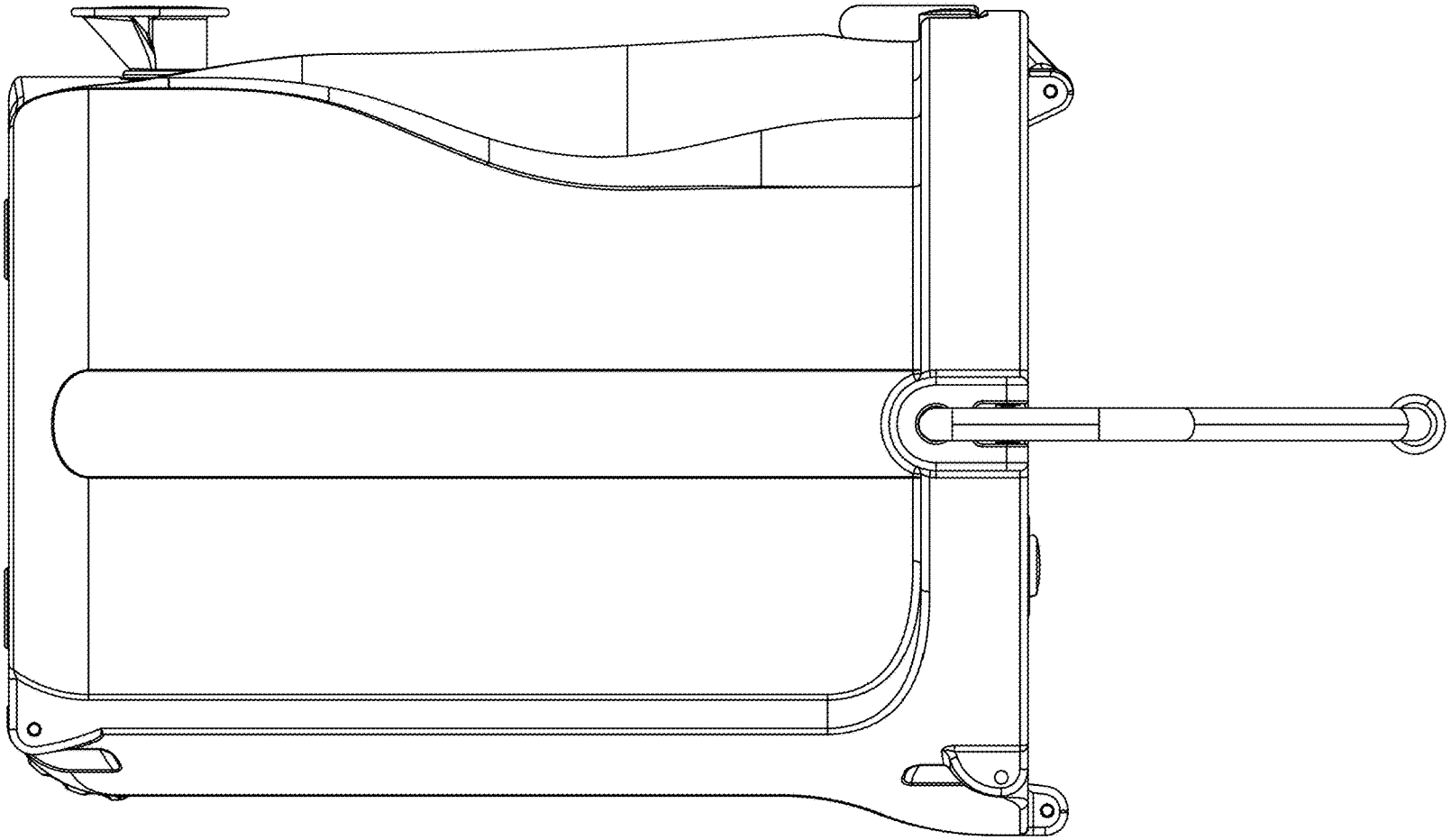
FIG. 34 is a photograph of a side view of a cooler, with the lid secured closed and with the handle swiveled up, according to an exemplary embodiment of the present disclosure.
Figure 35:
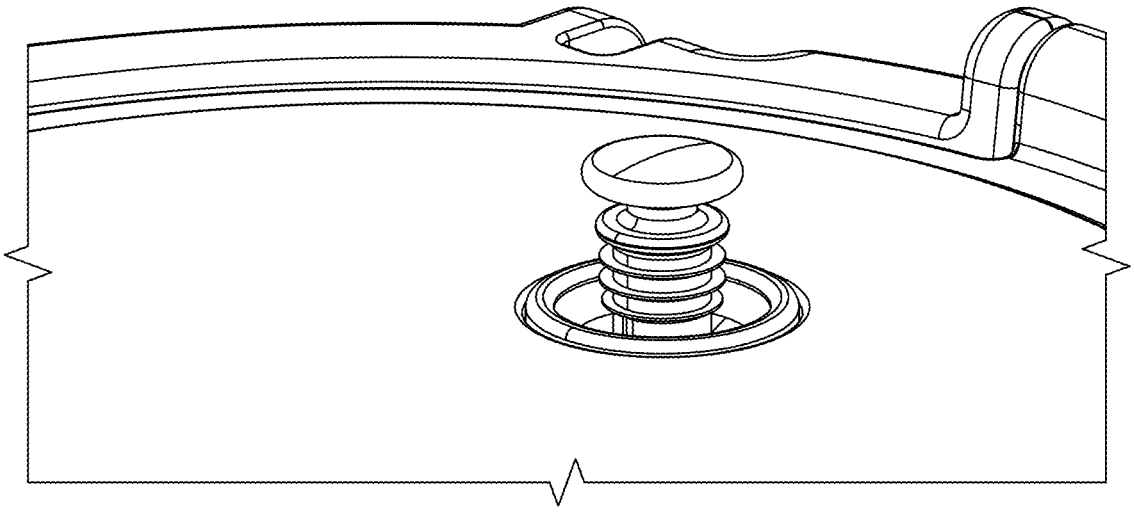
FIG. 35 is a photograph of a perspective view of part of a lid, showing the valve positioned therethrough, according to an exemplary embodiment of the present disclosure.
Figure 36:
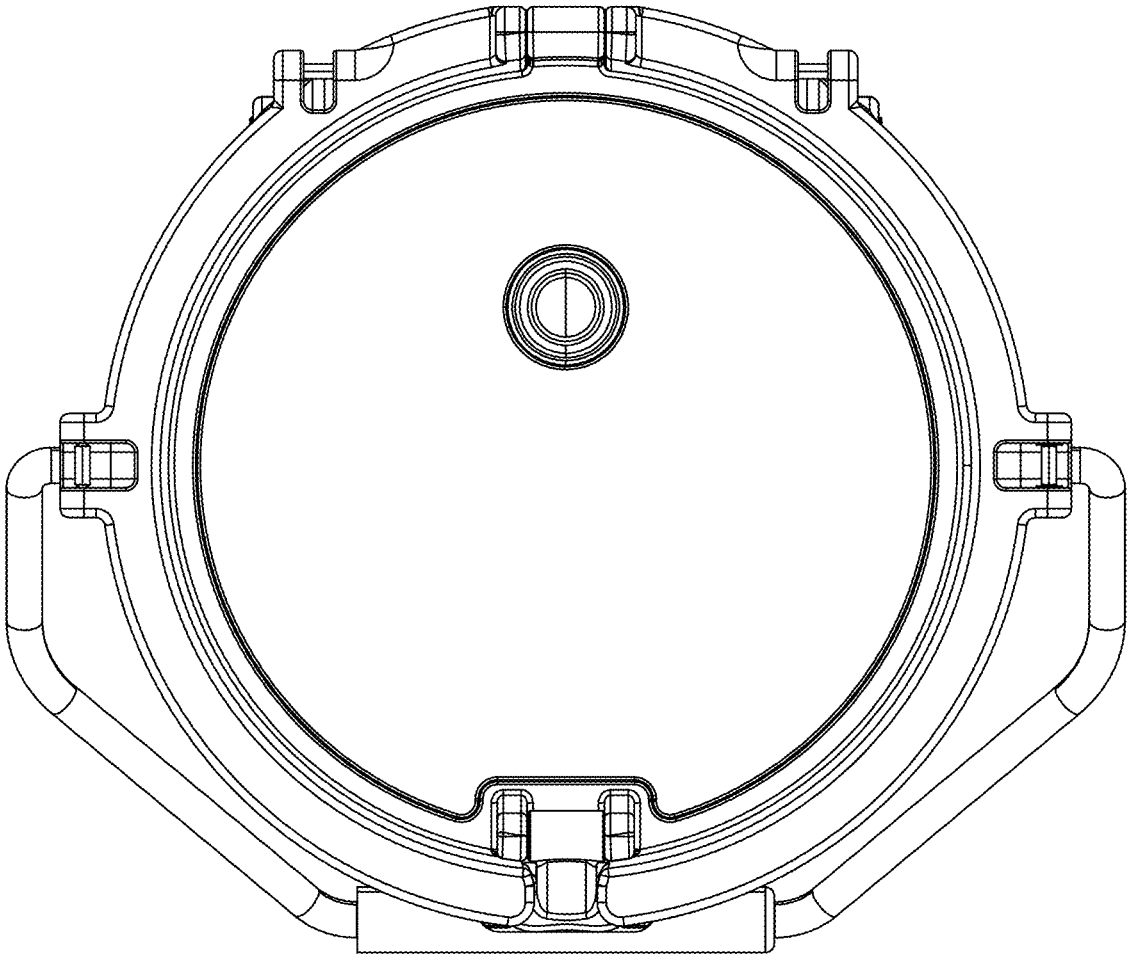
FIG. 36 is a photograph of a top view of part of a lid secured closed to the outer shell of the cooler, showing the valve positioned therethrough and with the handle swiveled down, and showing a seat feature of the lid configured to allow a person to sit on the lid when the lid is in a closed position, according to an exemplary embodiment of the present disclosure.

Lid 118, in various embodiments, has a gasket 150 thereon that engages a relative top 124 of outer shell 102 when lid 118 is closed, providing a leak proof seal. Alternatively, in some embodiments, an upper portion of outer shell 102 can have a gasket 150 coupled thereto or positioned relatively thereto, such as most clearly shown in FIG. 28, whereby said gasket 150 can contact lid 118 when lid 118 is closed. Lid 118 can therefore be pivoted open, such as shown pivoted open in FIG. 28, and pivoted and secured closed, such as shown in FIG. 29, for example.

Lid 118 can also have a vent mechanism 152, such as a spring-loaded vent mechanism 152, that when depressed can allow outside air to enter the cooler 100 (the inside 142 of insert 140, for example) so to allow beverages within insert 140 to more readily flow therefrom via tap 112.

Lid 118 can be secured closed by way of a latch 116, which can be made of plastic, metal, rubber, etc. For example, a rubber latch 116 would permit stretching so to engage a corresponding engagement feature 114 on the cooler 100, such as shown in FIGS. 27, 29, 30, 33, and 36.

Figure 2:
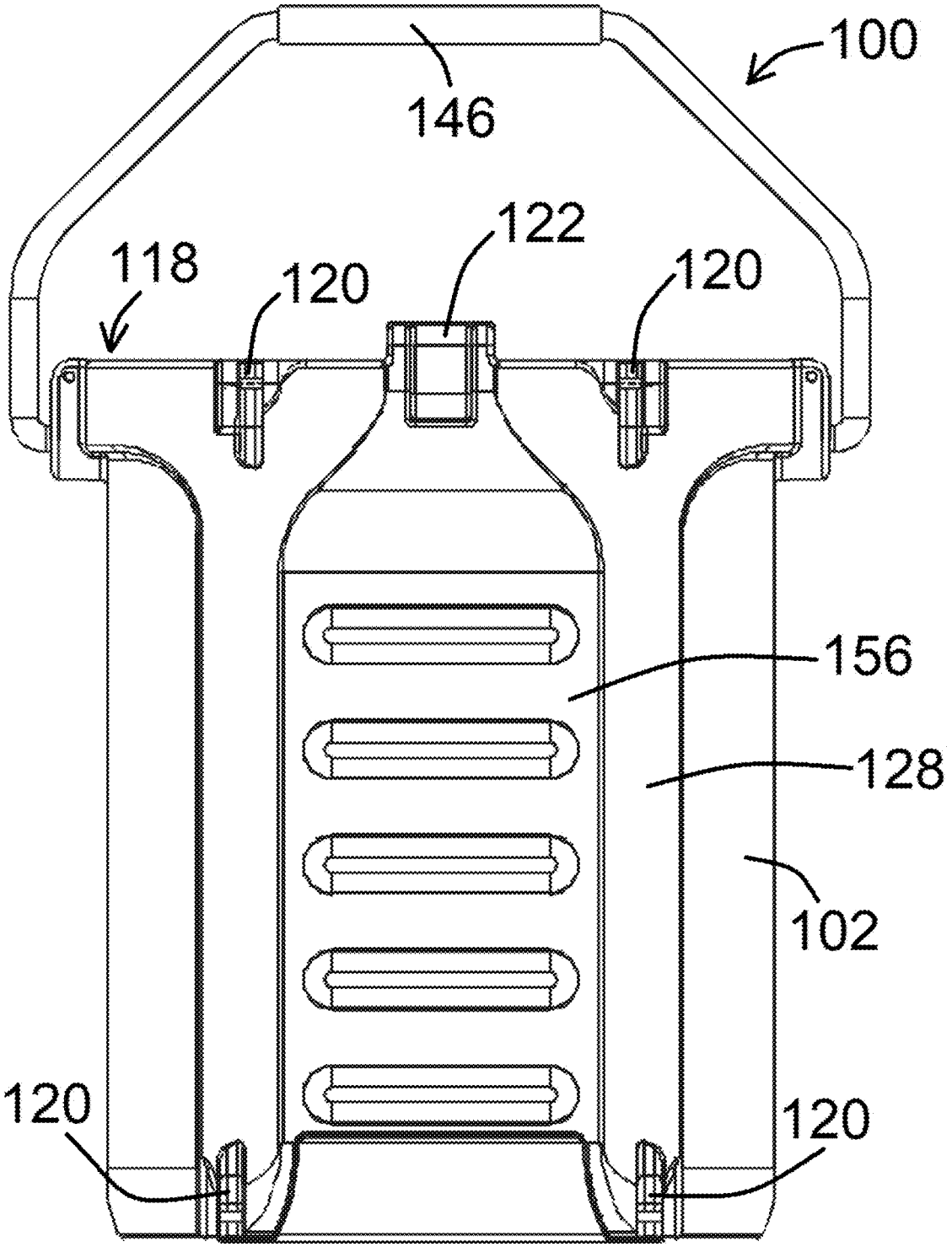
FIG. 2 shows a back view of the cooler of FIG. 1, according to an exemplary embodiment of the present disclosure.
Figure 3:
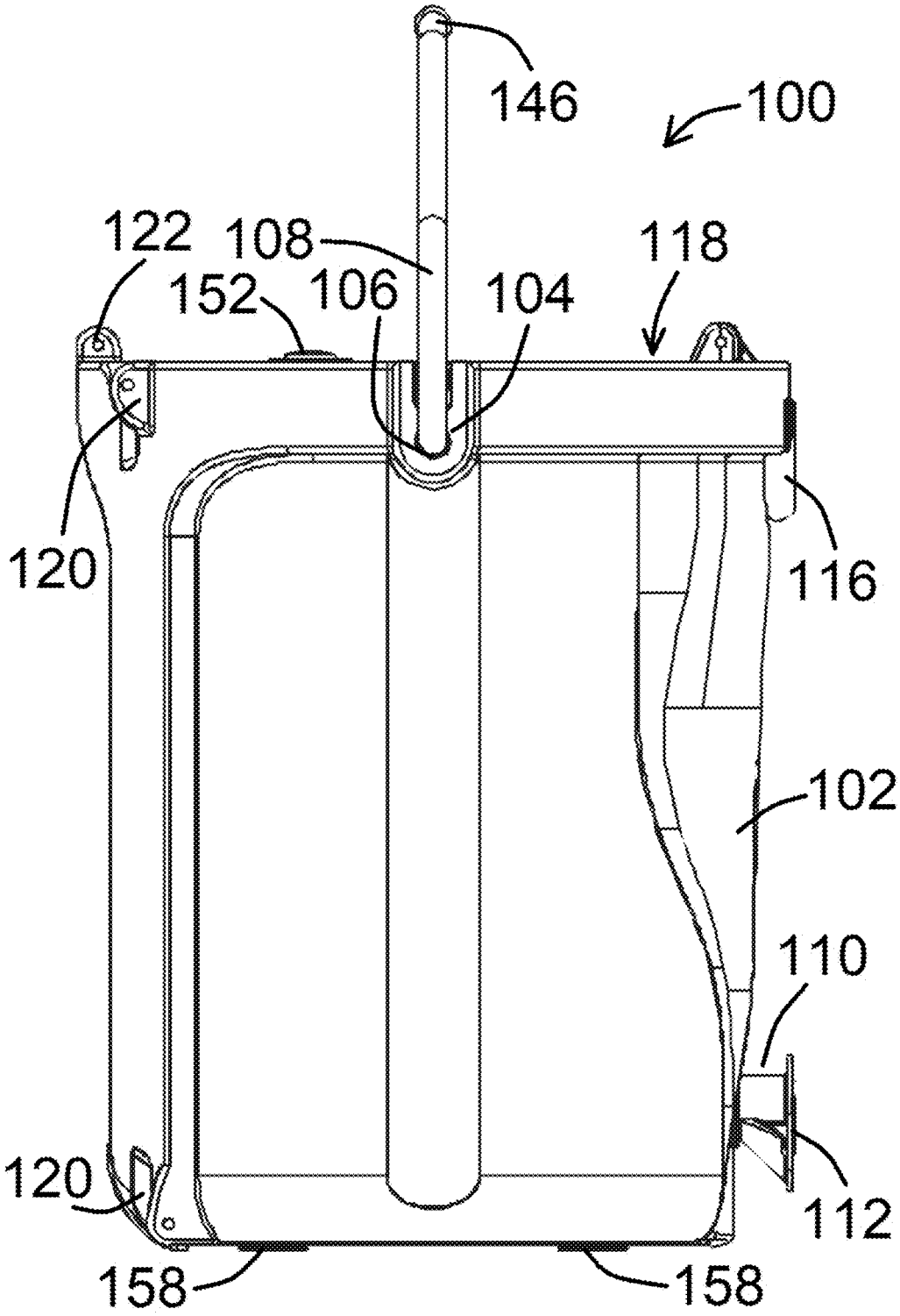
FIG. 3 shows a first side view of the cooler of FIG. 1, according to an exemplary embodiment of the present disclosure.
Figure 4:
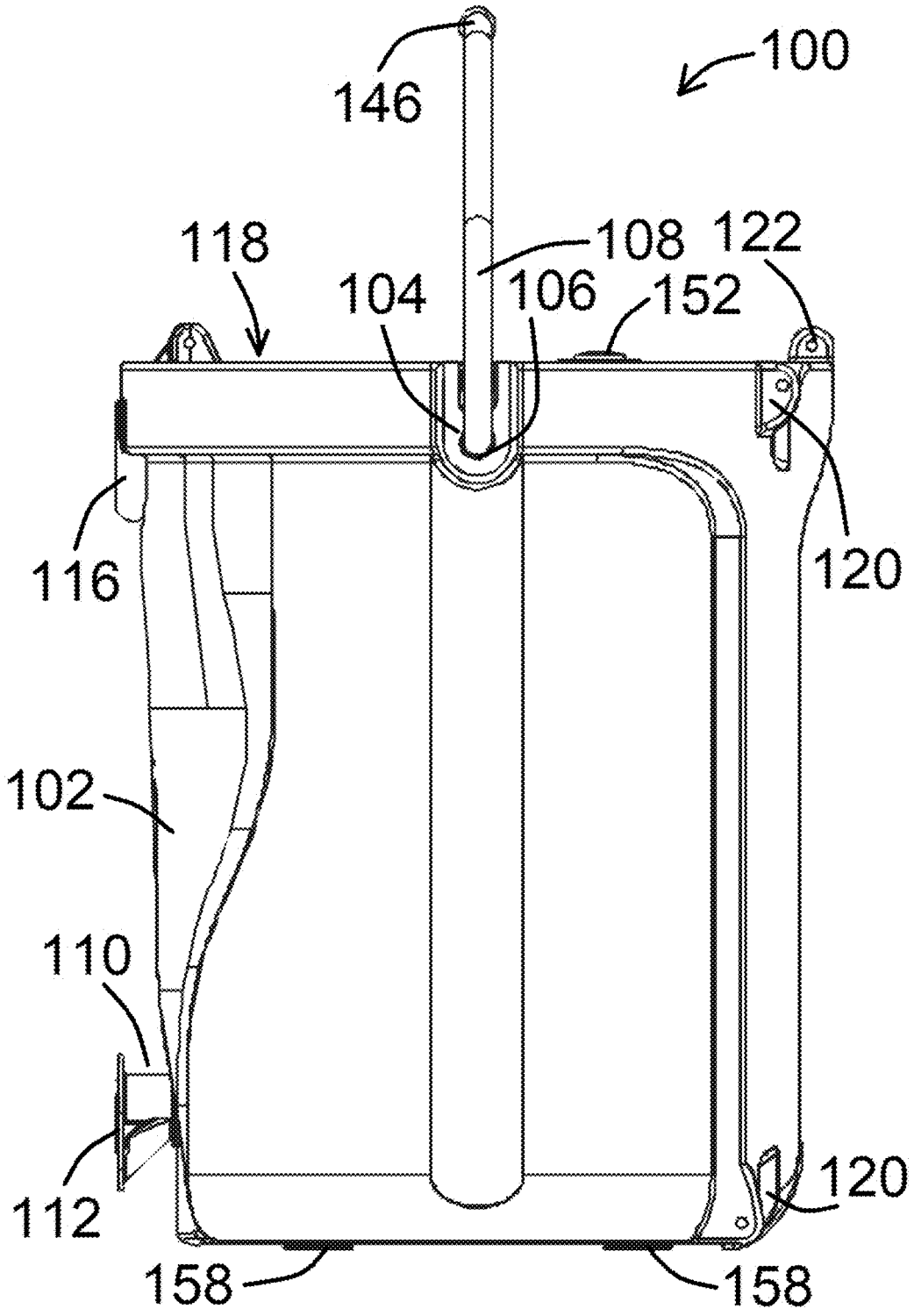
FIG. 4 shows a second side view of the cooler of FIG. 1, according to an exemplary embodiment of the present disclosure.
Figure 5:
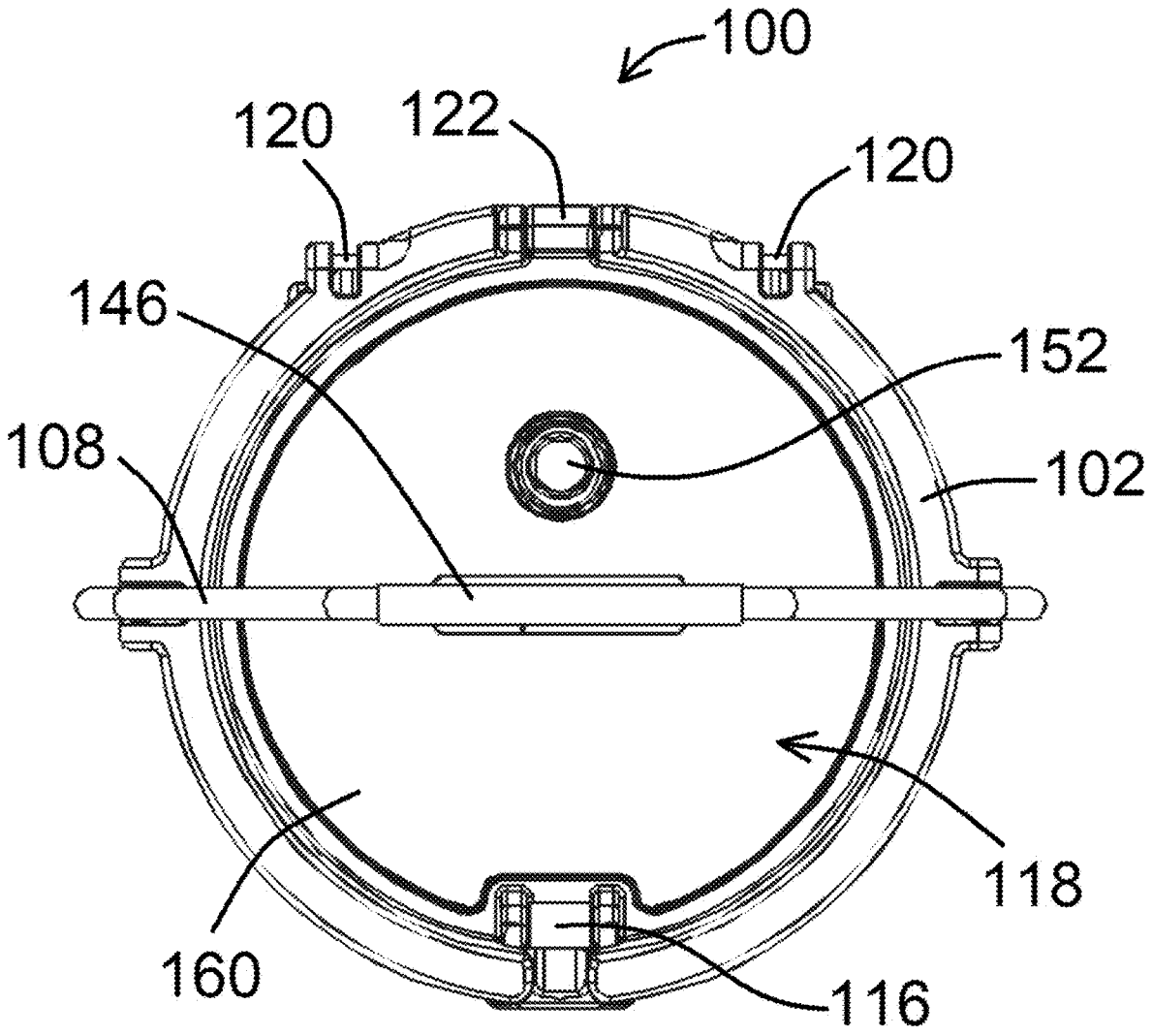
FIG. 5 shows a top view of the cooler of FIG. 1, according to an exemplary embodiment of the present disclosure.
Figure 6:
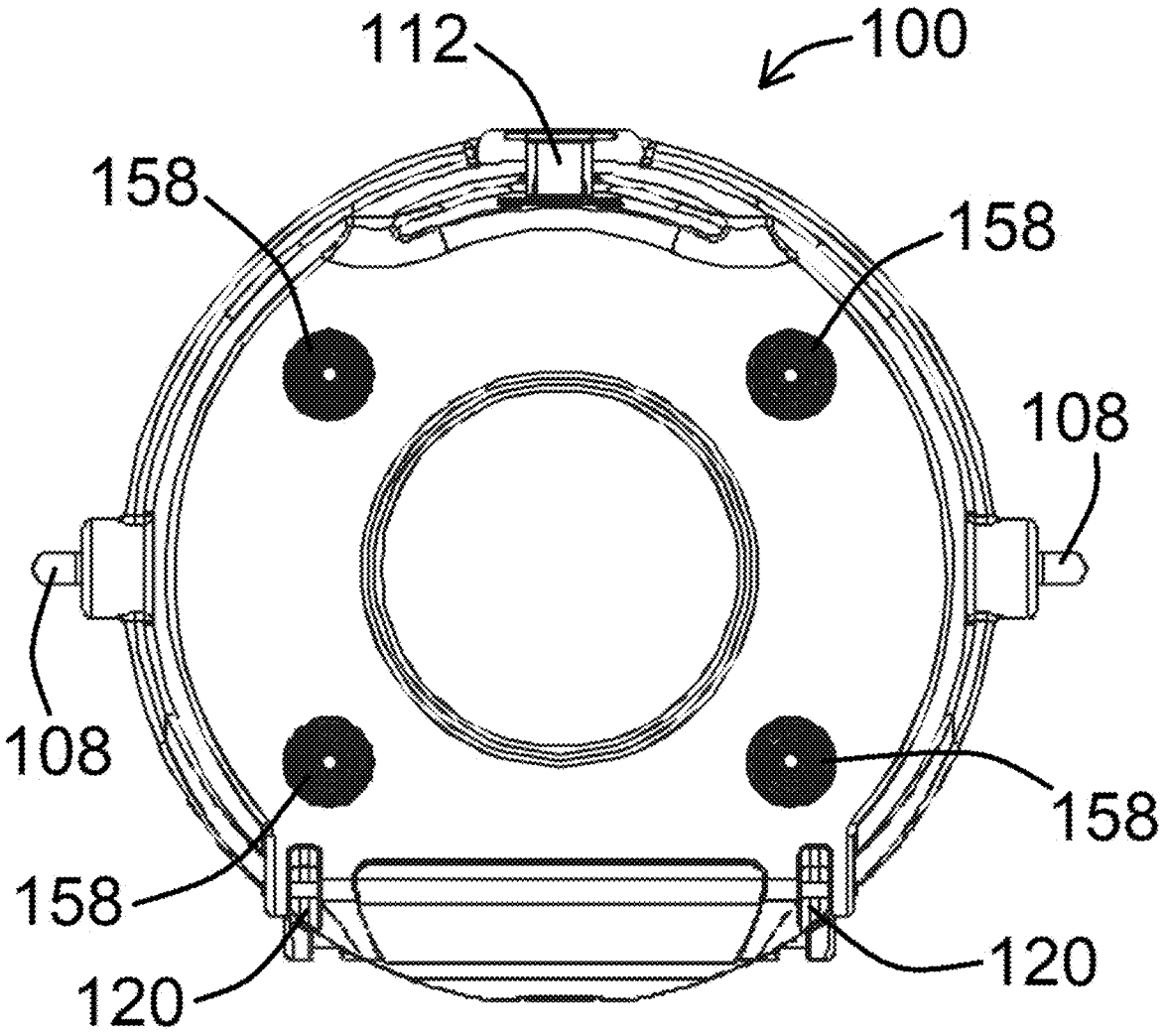
FIG. 6 shows a bottom view of the cooler of FIG. 1, according to an exemplary embodiment of the present disclosure.
Figure 7:
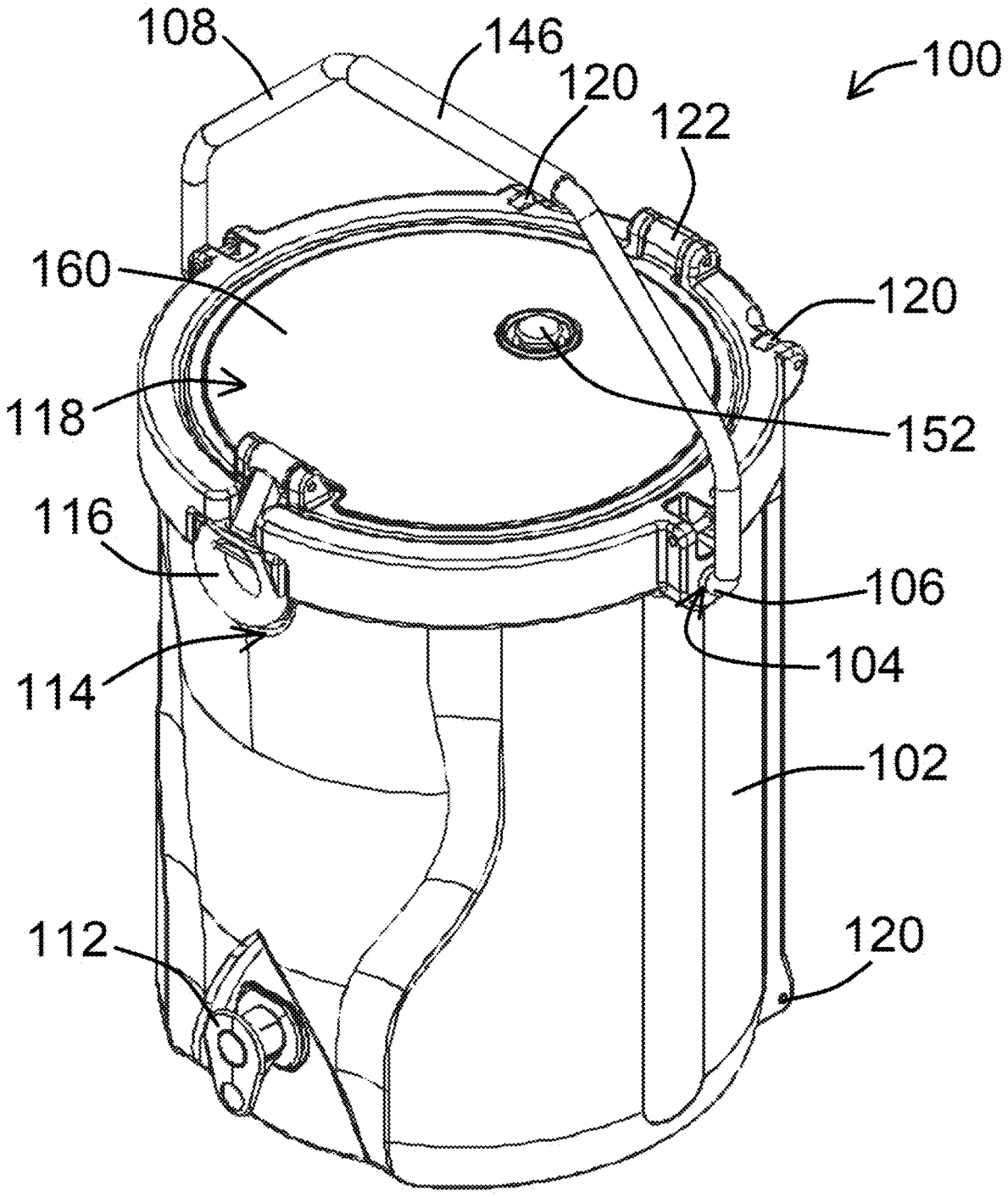
FIG. 7 shows a perspective view of the cooler of FIG. 1, according to an exemplary embodiment of the present disclosure.

The relative back 128 of an exemplary cooler 100 of the present disclosure can have a flat, concave, or less convex profile (an exemplary comfort profile 156), such as shown in FIG. 2, to allow for more comfortable use/positioning adjacent to the back of a user wearing the cooler 100 as a backpack.

Coolers 100 of the present disclosure can have feet 158, such as rubber feet 158 or feet 158 made of another compliant material, which helps keep the cooler 100 itself off of the ground or other surface contacted by the feet 158, and also provides grip via friction relative to the surface to help keep cooler 100 in place, especially when using tap 112.

When lid 118 of an exemplary cooler 100 of the present disclosure is closed, a user can sit on the seat feature 160 of the lid 118, whereby the cooler 100 itself is configured to support the weight of a seated adult (or an adult standing thereupon). Seat feature 160, in various embodiments, is made of a compliant material, such as rubber, foam, etc.

Exemplary coolers 100 of the present disclosure can be used to cool containers of beverage, liquid beverage, food, medications, and the like—essentially anything a user would like to keep cold. Coolers 100 can be rotomolded and leak proof or leak resistant, as referenced herein.

While various embodiments of portable beverage coolers and methods of using the same the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A cooler, comprising:

an outer shell having a general shape as a container, suitable to receive contents therein;

a handle pivotally coupled to the outer shell;

a removable insert configured to fit within the outer shell, said insert configured to receive a liquid or other items therein; and a hinged lid coupled to the outer shell and having a vent mechanism adapted to selectively allow gas exchange between an exterior of the cooler and the removable insert inside the outer shell when the hinged lid is closed.

2. The cooler of claim 1, further comprising:

a gasket, said gasket coupled to the hinged lid or to an upper portion of the outer shell configured to contact the hinged lid.

3. The cooler of claim 1, further comprising:

a tap in fluid communication with the inside of the insert, such that said tap is positioned through apertures defined within the outer shell and the insert.

4. The cooler of claim 1, further comprising:

a comfort grip on the handle.

5. The cooler of claim 1, wherein the hinged lid has a latch coupled thereto, said latch configured to engage an engagement feature defined within or protruding from the outer shell.

6. The cooler of claim 1, further comprising:

pliable feet positioned on a relative bottom of the outer shell.

7. The cooler of claim 1, further comprising:

at least two strap receivers defined within or present upon a relative back of the outer shell, the at least two strap receivers configured to engage connection portions of a backpack strap or a shoulder strap.

8. The cooler of claim 1, further comprising:

at least four strap receivers defined within or present upon a relative back of the outer shell, the at least four strap receivers configured to engage connection portions of one or more backpack straps.

9. The cooler of claim 1, further comprising:

a seat feature positioned upon the lid, the seat feature configured to provide comfort to a user seated upon said seat feature.

10. The cooler of claim 1, further comprising:

a gasket, said gasket coupled to the hinged lid or to an upper portion of the outer shell configured to contact the hinged lid; and a tap in fluid communication with the inside of the insert, such that said tap is positioned through apertures defined within the outer shell and the insert.

11. The cooler of claim 10, further comprising:

a comfort grip on the handle.

12. The cooler of claim 10, wherein the hinged lid has a latch coupled thereto, said latch configured to engage an engagement feature defined within or protruding from the outer shell.

13. The cooler of claim 10, further comprising:

pliable feet positioned on a relative bottom of the outer shell.

14. The cooler of claim 10, further comprising:

at least two strap receivers defined within or present upon a relative back of the outer shell, the at least two strap receivers configured to engage connection portions of a backpack strap or a shoulder strap.

15. The cooler of claim 10, further comprising:

at least four strap receivers defined within or present upon a relative back of the outer shell, the at least four strap receivers configured to engage connection portions of one or more backpack straps.

16. The cooler of claim 10, further comprising:

a seat feature positioned upon the lid, the seat feature configured to provide comfort to a user seated upon said seat feature.

17. The cooler of claim 1, further comprising a tap, wherein the vent mechanism is further adapted to allow a beverage stored within the removable insert to more readily flow therefrom via the tap.

18. A cooler, comprising:

an outer shell having a general shape as a container, suitable to receive contents therein;

a handle pivotally coupled to the outer shell;

a removable insert configured to fit within the outer shell, said insert configured to receive a liquid or other items therein;

a hinged lid coupled to the outer shell and having a vent mechanism adapted to selectively allow gas exchange between an exterior of the cooler and the removable insert within the outer shell when the hinged lid is closed;

a gasket, said gasket coupled to the hinged lid or to an upper portion of the outer shell configured to contact the hinged lid;

a tap in fluid communication with the inside of the insert, such that said tap is positioned through apertures defined within the outer shell and the insert; and at least two strap receivers defined within or present upon a relative back of the outer shell, the at least two strap receivers configured to engage connection portions of a backpack strap or a shoulder strap;

wherein the hinged lid has a latch coupled thereto, said latch configured to engage an engagement feature defined within or protruding from the outer shell.

19. The cooler of claim 18, further comprising:

pliable feet positioned on a relative bottom of the outer shell; and a seat feature positioned upon the lid, the seat feature configured to provide comfort to a user seated upon said seat feature.

20. The cooler of claim 18, further comprising a tap, wherein the vent mechanism is further adapted to allow a beverage stored within the removable insert to more readily flow therefrom via the tap.

* * * * *